US010321219B2

(12) United States Patent
Olson et al.

(10) Patent No.: US 10,321,219 B2
(45) Date of Patent: Jun. 11, 2019

(54) EARPHONE TIP WITH UNIVERSAL SOUND PORT ATTACHMENT CORE

(71) Applicant: HEARING COMPONENTS, INC., Oakdale, MN (US)

(72) Inventors: Thaddeus W. Olson, Lake Elmo, MN (US); Justin C. Peskar, Woodbury, MN (US); Martin Ganser, St. Paul, MN (US)

(73) Assignee: HEARING COMPONENTS, INC., Oakdale, MN (US)

( * ) Notice: Subject to any disclaimer, the term of this patent is extended or adjusted under 35 U.S.C. 154(b) by 136 days.

(21) Appl. No.: 15/391,081

(22) Filed: Dec. 27, 2016

(65) Prior Publication Data

US 2017/0188133 A1 Jun. 29, 2017

Related U.S. Application Data

(60) Provisional application No. 62/271,521, filed on Dec. 28, 2015.

(51) Int. Cl.
*H04R 1/10* (2006.01)

(52) U.S. Cl.
CPC ..... *H04R 1/1066* (2013.01); *H04R 1/1016* (2013.01)

(58) Field of Classification Search
CPC .. H04R 25/65; H04R 25/606; H04R 2225/61; H04R 2460/13
USPC ..... 381/380
See application file for complete search history.

(56) References Cited

U.S. PATENT DOCUMENTS

| | | | |
|---|---|---|---|
| 5,002,151 | A | 3/1991 | Oliveira et al. |
| 6,129,174 | A | 10/2000 | Brown et al. |
| 6,671,381 | B1 | 12/2003 | Lux-Wellenhof |
| 7,116,793 | B2 | 10/2006 | Seto |
| 7,236,605 | B2 | 6/2007 | Oliveira et al. |
| 7,600,604 | B2 | 10/2009 | Babcock et al. |
| 7,837,005 | B2 | 11/2010 | Killion |
| 8,061,472 | B2 | 11/2011 | Tiemens |
| 8,101,103 | B2 | 1/2012 | Tiemens et al. |
| 8,116,495 | B2 | 2/2012 | Spaulding |

(Continued)

FOREIGN PATENT DOCUMENTS

| | | | |
|---|---|---|---|
| EP | 1032243 | A2 | 8/2000 |
| JP | 2008277909 | A | 11/2008 |
| WO | 2010037752 | A1 | 4/2010 |

OTHER PUBLICATIONS

International Search Report and Written Opinion dated Apr. 6, 2017 for International Application No. PCT/US2016/068677.

*Primary Examiner* — Sean H Nguyen
(74) *Attorney, Agent, or Firm* — Seager, Tufte & Wickhem LLP

(57) ABSTRACT

Earbud adapter and earbud tip devices are discussed in the present disclosure. In one exemplary embodiment, an adapter may be configured to be detachably coupled to an earbud-type sound device or other sound device. The adapter may comprise a hollow adapter body extending from a proximal end to a distal end along a central longitudinal axis having a proximal portion including a lead in face that aids in placement of a tip on an earbud device and a distal portion having at least one retention member extending radially inward where, in combination, the features can allow positioning and adequate retention of an earbud tip on various configurations of earbuds.

26 Claims, 21 Drawing Sheets

(56) References Cited

U.S. PATENT DOCUMENTS

| | | | | |
|---|---|---|---|---|
| 8,175,308 | B2 | 5/2012 | Olsen et al. | |
| 8,189,845 | B2 | 5/2012 | Mulvey | |
| 8,270,648 | B2 | 9/2012 | Murozaki | |
| 8,280,093 | B2 | 10/2012 | Siahaan et al. | |
| 8,327,973 | B2 | 12/2012 | Parish et al. | |
| 8,391,536 | B2 | 3/2013 | Hashimoto | |
| 8,413,331 | B2 | 4/2013 | Tiemens et al. | |
| 8,761,424 | B2 * | 6/2014 | Wubker | H04R 25/654 381/325 |
| 8,774,444 | B2 | 7/2014 | Tiscareno et al. | |
| 8,983,108 | B2 | 3/2015 | Ho | |
| 2005/0147269 | A1 | 7/2005 | Oliveira et al. | |
| 2006/0067556 | A1 | 3/2006 | Bailey et al. | |
| 2008/0187161 | A1 | 8/2008 | Tiemens et al. | |
| 2009/0052711 | A1 | 2/2009 | Murozaki | |
| 2011/0036661 | A1 * | 2/2011 | Munro | A61F 11/08 181/135 |
| 2011/0223864 | A1 | 9/2011 | Wai | |
| 2011/0268308 | A1 | 11/2011 | Vasquez | |
| 2012/0312628 | A1 | 12/2012 | Siahaan et al. | |
| 2013/0188819 | A1 | 7/2013 | Young-Mun | |
| 2015/0060189 | A1 | 3/2015 | Iseberg et al. | |
| 2015/0146909 | A1 | 5/2015 | Kirkpatrick | |
| 2015/0181330 | A1 * | 6/2015 | Rogers | H04R 1/1016 381/67 |

* cited by examiner

EARPHONE TIP WITH UNIVERSAL SOUND PORT ATTACHMENT CORE

CROSS-REFERENCE TO RELATED APPLICATIONS

This application claims priority to U.S. Provisional Application No. 62/271,521, filed on Dec. 28, 2015, the entire disclosure of which is incorporated herein by reference.

TECHNICAL FIELD

The present disclosure pertains to sound devices and earphone tips for use with sound devices. More particularly, the present invention pertains to earphone tips for use with earbud-type headphones that provide a sturdy yet removable connection to the headphone for a wide range of sound port designs present on available headphones.

BACKGROUND

Sound devices such as headphones are used extensively throughout the world. One style of headphones that is commonly used is referred to as an earbud or an earbud-type headphone. Earbuds (i.e. earphones) are small speaker-like devices that are designed to fit within the external ear of a listener so that the user can listen to sound being transmitted from a sound source. Some examples of typical sound sources where earbuds may be used include personal and/or portable audio players (including radios, cassette players, compact disc players, portable mp3 players, etc.), portable DVD players, telephones (including wireless and cellular-type telephones), tablets, etc. When properly positioned in the ear, earbuds can provide the listener with acceptable sound transmission to the ear canal. Sound tubes or ports of earbuds are intended to channel sound transmitted from the driver (e.g., speaker) of the sound device into the ear canal of a user. Soft, flexible earphone tips have been developed for connection to a sound tube of an earbud which are configured to be received within the ear canal of a user to achieve a firm, yet comfortable fit for the user. Earphone tips must be replaced regularly. Therefore, the connection of the earphone tip to the sound tube must be detachable coupled, in other words, the user must be able to both position the earphone tip on the sound tube and remove/change the tip. When positioned on the sound tube the earphone tip/sound tube interface must provide sufficient retention to maintain the tip on the sound tube when in use, including during insertion and removal from the ear. However, there are currently many different earbud sound tube designs employing different configurations of earphone tip connection types for connection to the different sound tube configurations. Each of the earphone tips is typically designed to fit a single configuration of sound tube. If a user purchases replacement earphone tips not specifically designed for their earphone sound tube, the interface between the earphone tip and sound tube may be inadequate. With the wide range of sound tube designs on earbuds on the market there is a need for an earphone tip including design features that provide a universal connection regardless of design of the sound tube on the device.

SUMMARY

The present disclosure relates to sound devices and earphone tips for use with sound devices.

One exemplary embodiment is an earphone tip configured to be detachably coupled to an earbud-type sound device or other sound device, regardless of sound tube diameter and external surface features. The earphone tip includes an adapter body including a proximal portion and a distal portion having a lumen extending therethrough from a proximal end to a distal end along a central longitudinal axis. The adapter body also includes a lead-in face in the proximal portion of the lumen defined by a distally extending reduction in lumen diameter that aids insertion of the sound tube into the lumen. The reduction in diameter being from a larger diameter of about 4.0 mm (0.157 inches) to about 8.4 mm (0.330 inches) to a smaller diameter of about 2.0 mm (0.078 inches) to about 4.1 mm (0.161 inches) over an axial length of the lumen of about 0.5 mm (0.019 inches) to about 1.7 mm (0.067 inches). The adapter body further includes one or more retention members in the distal portion of the lumen. The one or more retention members extend radially inward within the lumen. The distal portion of the lumen has a diameter of about 3.0 mm (0.110 inches) to about 5.1 mm (0.200 inches) and the one or more retention members extend inward a distance of about 0.127 mm (0.005 inches) to about 1.5 mm (0.060 inches). The one or more retention members are located within a range of about 0.8 mm (0.030 inches) to about 1.8 mm (0.070 inches) from the proximal end of the lumen.

Additionally or alternatively to any of the embodiments above, the adapter body may further include a radially outwardly extending flange disposed proximate the proximal end of the adapter body.

Additionally or alternatively to any of the embodiments above, the face slopes at an angle between 30 degrees and 60 degrees with respect to the central longitudinal axis.

Additionally or alternatively to any of the embodiments above, the face has a lower static coefficient of friction than the internal surface of the adapter body.

Additionally or alternatively to any of the embodiments above, the face comprises a material having a lower static coefficient of friction than the static coefficient of friction of the material of the internal surface of the adapter body.

Additionally or alternatively to any of the embodiments above, the face is coated with a material having a lower static coefficient of friction than the static coefficient of friction of the material of the internal surface of the adapter body.

Additionally or alternatively to any of the embodiments above, the one or more retention members are located a distance from the proximal end that is less than forty percent of a distance between the proximal end and the distal end of the adapter body.

Additionally or alternatively to any of the embodiments above, the one or more retention members project from the internal surface at an angle between 30 degrees and 150 degrees.

Additionally or alternatively to any of the embodiments above, the adapter body comprises a material having a Shore hardness value between 40 A and 80 A.

Additionally or alternatively to any of the embodiments above, the adapter body is formed of a material having a Shore hardness of 40 A to 65 A, a tensile modulus at 100% elongation of 350 psi or less, or less than 350 psi, and a static coefficient of friction of 0.75 to 2.5.

Additionally or alternatively to any of the embodiments above, the adapter body comprises a longitudinally extending groove in an outer surface of the adapter body.

Additionally or alternatively to any of the embodiments above, the earphone tip further comprises a cushion circumferentially surrounding the adapter body and configured to frictionally engage an ear canal of a user.

Additionally or alternatively to any of the embodiments above, the cushion is formed as a monolithic structure with the adapter body.

Additionally or alternatively to any of the embodiments above, the cushion and the adapter body are made of a silicone material.

Additionally or alternatively to any of the embodiments above, the cushion is formed of a polymeric foam material.

Another exemplary embodiment is an earphone tip configured to be detachably coupled to a sound port of an earbud-type sound device or other sound device, regardless of sound port design. The earphone tip includes an adapter body extending from a proximal end to a distal end, wherein an internal surface of the adapter body defines a lumen extending through the adapter body along a central longitudinal axis. The proximal end of the adapter body extends a first distance radially from the longitudinal axis and the distal end of the adapter body extends a second distance radially from the longitudinal axis, the first distance being greater than the second distance. The lumen further defines an axially extending proximal portion and a distal portion. The adapter body also includes a lead-in face in the proximal portion of the lumen defined by a distally extending reduction in lumen diameter that aids insertion of the sound tube into the lumen. The reduction in diameter being from a larger diameter of about 4.0 mm (0.157 inches) to about 8.4 mm (0.330 inches) to a smaller diameter of about 2.0 mm (0.078 inches) to about 4.1 mm (0.161 inches) over an axial length of the lumen of about 0.5 mm (0.019 inches) to about 1.7 mm (0.067 inches). The adapter body further includes one or more retention members in the distal portion of the lumen. The one or more retention members extend radially inward within the lumen. The distal portion of the lumen has a diameter of about 3.8 mm (0.150 inches) to about 5.1 mm (0.200 inches) and the one or more retention members extend inward a distance of about 0.127 mm (0.005 inches) to about 1.5 mm (0.060 inches). The one or more retention members are located within a range of about 0.8 mm (0.030 inches) to about 1.8 mm (0.070 inches) from the proximal end of the lumen.

Additionally or alternatively to any of the embodiments above, the inwardly extending face has a lower static coefficient of friction than the internal surface of the adapter body.

Additionally or alternatively to any of the embodiments above, the inwardly extending face slants away from the proximal end of the adapter body at an angle of between 30 degrees and 60 degrees.

Additionally or alternatively to any of the embodiments above, the adapter body comprises a plastic material.

Additionally or alternatively to any of the embodiments above, the plastic material has a Shore hardness of 40 A to 65 A, a tensile modulus at 100% elongation of 350 psi or less, and a static coefficient of friction of 0.75 to 2.5.

Additionally or alternatively to any of the embodiments above, the inwardly extending face extends toward the distal end of the adapter body to a point a distance away from the proximal end that is between 10% and 40% of a distance between the proximal end of the adapter body and the distal end of the adapter body.

Additionally or alternatively to any of the embodiments above, the adapter body has a longitudinally extending groove formed in an exterior surface of the adapter body. Yet another exemplary embodiment is an earphone tip detachably coupleable to an earbud-type sound device or other sound device. The earphone tip includes an adapter body and a cushion attached to the adapter body. The adapter body includes a lumen extending from a proximal end to a distal end along a central longitudinal axis. The cushion is configured to frictionally engage an ear canal of a user. The adapter body is configured to connect securely to any one of a plurality of different sound port configurations of an earbud-type sound device or other sound device.

Additionally or alternatively to any of the embodiments above, the adapter body further comprises an internal surface defining the lumen and an internal rim extending inwardly from the internal surface of the adapter body.

Additionally or alternatively to any of the embodiments above, the adapter body further comprises a longitudinally extending groove formed in an exterior surface of the adapter body.

Additionally or alternatively to any of the embodiments above, the adapter body is formed of a material having a Shore hardness of 40 A to 65 A, a tensile modulus at 100% elongation of 350 psi or less, or less than 350 psi, and a static coefficient of friction of 0.75 to 2.5.

The above summary of some embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The invention may be more completely understood in consideration of the following detailed description of various embodiments in connection with the accompanying drawings, in which.

Figure 1:
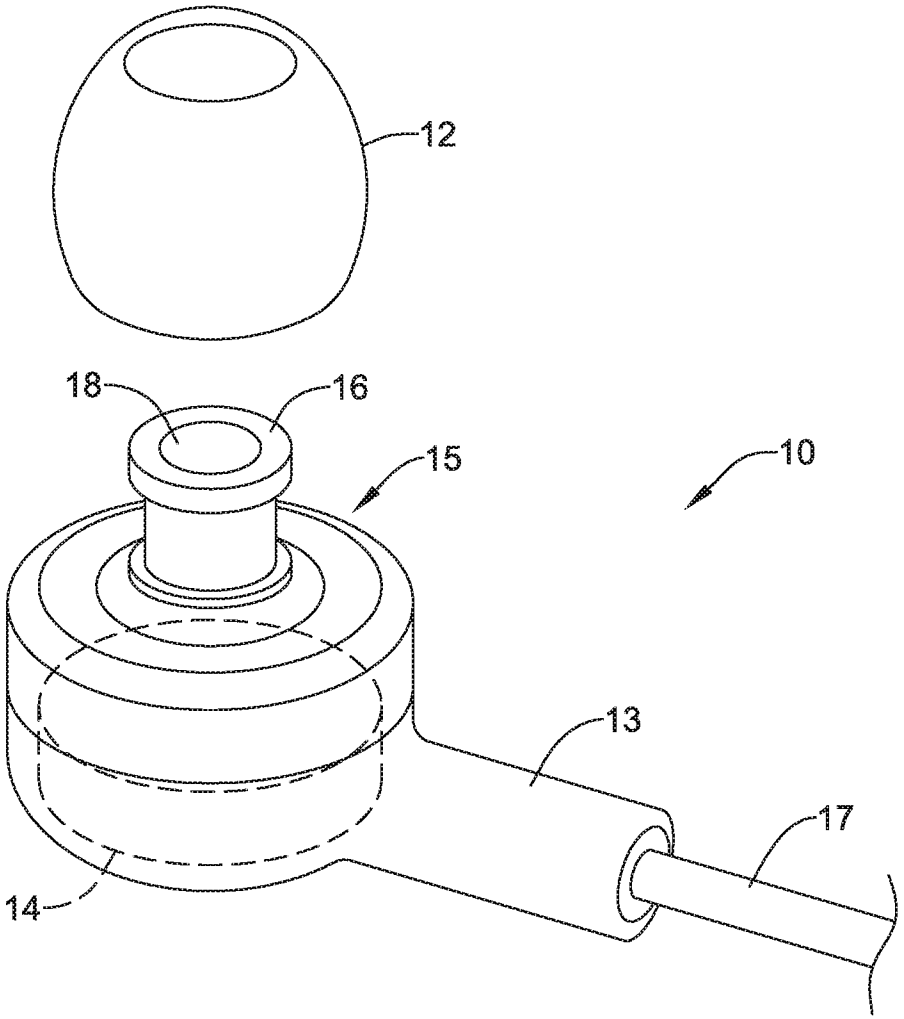
FIG. 1 is a perspective view of an exemplary earbud and earphone tip.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). As used herein, the use of the term "about" with numerical values includes numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the disclosure.

FIG. 1 is a perspective view of an example earphone (i.e., earbud) 10 and earphone tip 12. Earphone 10 may generally comprise a case or housing 13 which contains a speaker or driver 14. The housing 13 may generally be formed from a plastic material and form a relatively rigid structure. In the example of FIG. 1, the housing 13 is generally cylindrical in nature, but this is just one example. In general, the housing 13 may take any shape or form to enclose components of the earphone 10.

Wire 17, also shown in FIG. 1, may enter the housing 13 along one side of the housing 13 and connect to the speaker or driver 14 within the housing 13. Wire 17 can provide power and/or a sound signal to the speaker or driver 14, and the speaker or driver 14 may produce sound based on the delivered power and/or sound signal.

One feature that may be common among earphones, as shown in FIG. 1 with respect to earphone 10, is the inclusion of a sound port. For instance, the earphone 10 includes a sound port or sound tube 15 extending outward from a distal portion of the housing 13. The sound port 15 may generally direct sound produced by the speaker or driver 14 away from the speaker or driver 14 and out of the housing 13 through the sound port opening 18. Structurally, the sound port 15 can be a generally cylindrical member projecting distally from the housing 13 and having a lumen extending therethrough to pass sound from the speaker or driver into the ear of the user. The outer surface of the sound port 15 in current designs include many features and shapes intended to aid in the interface between the sound port 15 and the ear tip 12 as described below with respect to FIGS. 2A-2D.

The earphone 10 may generally be configured for insertion into the ear of a user with the sound port 15 extending toward (distally) and/or into an ear canal of the user. For example, a user may insert the sound port 15 and ear tip 12 combination into an ear canal in order to direct sounds generated by the speaker or driver 14 through the sound port 15, out the sound port opening 18, and into the ear canal. Due to the housing 13 being made from a solid material, inserting the sound port 15 directly into an ear canal can be uncomfortable. Accordingly, an earphone tip 12 may be connected to the sound port 15 for frictionally engaging the ear canal of the user, while at the same time providing varying degrees of external sound reaching the ear canal depending on the earphone tip 12 design.

The earphone tip 12 may be comprised of a soft, flexible material that is easily deformable. Accordingly, when a user inserts the earphone 10 into their ear with the earphone tip 12 connected, the earphone tip 12 may deform to fit within the ear canal and provide a soft, cushiony interface between the earphone 10 and the ear canal. The deformable nature of the earphone tip 12 may additionally frictionally engage the ear canal of the user to retain the earphone 10 in the user's ear and/or act to seal off ear canal, thereby reducing or eliminating noise external to earphone 10 from entering the ear canal.

The sound port 15 may include one or more external surface features on the generally cylindrical surface of the sound port 15 for connecting to an earphone tip, such as earphone tip 12. In the example of FIG. 1, the sound port 15 includes a flange 16 located at or near the sound port opening 18 at the edge of the sound port 15 furthest away from the housing 13. However, this is just one example connection feature that the sound port 15 may employ to connect to an earphone tip, such as earphone tip 12. In general, the sound port 15 may include one of many different connection features, for example those depicted with respect to FIGS. 2A-2D.

Figure 2B:
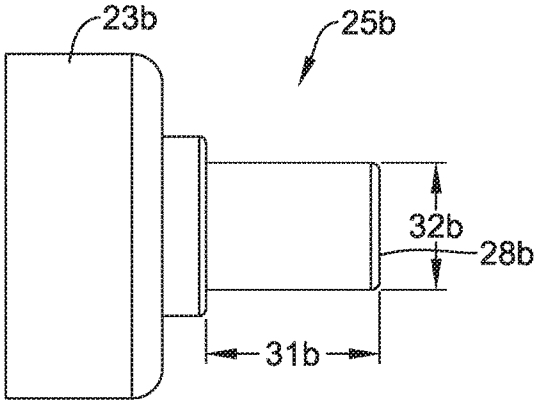
FIGS. 2A-2D are plan views of exemplary sound ports that may be used in conjunction with an earphone tip of the present disclosure.
Figure 2A:
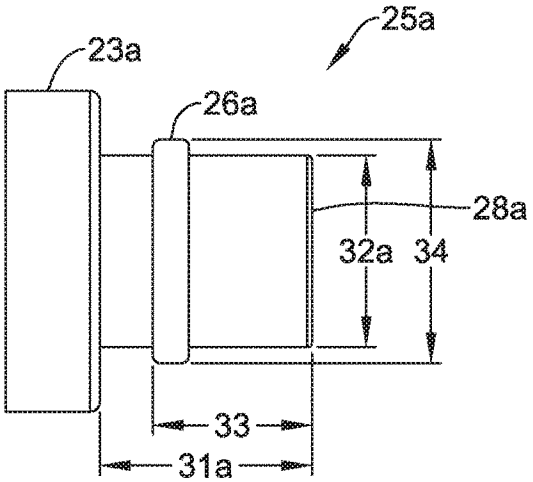

FIGS. 2A-2D generally depict alternative example sound ports including different external surface or connection features for connecting to earphone tips. FIG. 2A depicts an exemplary sound port 25*a* connected to an exemplary housing 23*a*. The sound port 25*a* may be categorized as a "barbed sound port." The sound port 25*a* may have a length 31*a*

(measured from a proximal end of the sound port 25*a*, attached to the housing 23*a*, to a free end of the sound port 25*a* along the central longitudinal axis of the sound port 25*a*) and a width or diameter 32*a* (measured perpendicular to the length 31*a*, and thus the central longitudinal axis).

Additionally, the sound port 25*a* may include a barb or flange 26*a* generally disposed on the sound port 25*a* at a location between the sound port opening 28*a* and the housing 23*a*. For instance, the side of the barb or flange 26*a* disposed most closely to the housing 23*a* may be a distance 33 away from the free end of the sound port 25*a* comprising the sound port opening 28*a*. In other embodiments, the barb or flange 26*a* may be disposed directly at the free end of the sound port 25*a* adjacent the sound port opening 28*a*. The barb or flange 26*a* may have a width or diameter 34 (measured perpendicular to the length 31*a*, and thus the central longitudinal axis) that is generally greater than the width 32*a* of the sound port 25*a*. In some embodiments, the length 31*a* of the sound port 25*a* may be generally greater than the width 34 of the barb or flange 26*a*, however, in other embodiments the length 31*a* of the sound port 25*a* may be equal to or less than the width 34 of the barb or flange 26*a*.

FIG. 2B depicts another exemplary sound port 25*b* connected to an exemplary housing 23*b*. The sound port 25*b* may be categorized as a "straight sound port." In the example of FIG. 2B, the sound port 25*b* does not include a barb or flange and provides a generally cylindrical outer surface over its length. For instance, the sound port 25*b* extends away from the housing 23*b* to a sound port opening 28*b* at a free end of the sound port 25*b* without any protrusions along its length. The sound port 25*b* may have a length 31*b* (measured from a proximal end of the sound port 25*b*, attached to the housing 23*b*, to a free end of the sound port 25*b* along the central longitudinal axis of the sound port 25*b*) and a width or diameter 32*b* (measured perpendicular to the length 31*a*, and thus the central longitudinal axis).

Figure 2D:
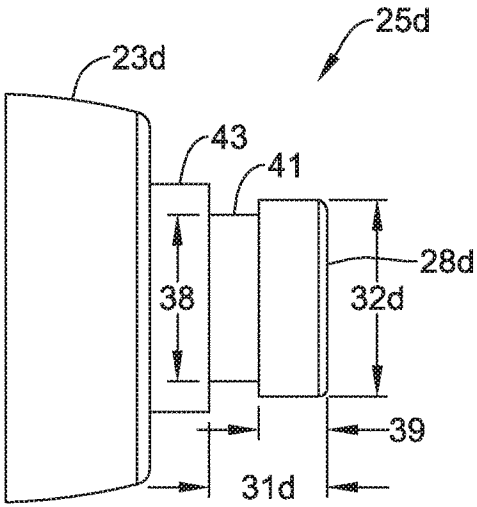
Figure 2C:
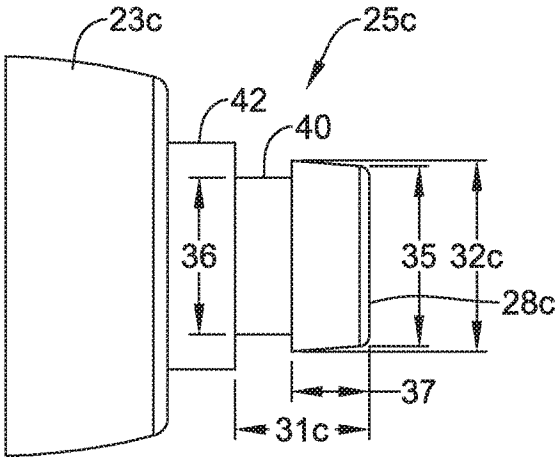

FIG. 2C depicts another exemplary sound port 25*c* connected to an exemplary housing 23*c*. The sound port 25*c* may be categorized as a "cone sound port". In the embodiment of FIG. 2C, instead of including a barb or flange located along the sound port 25*c*, the sound port 25*c* includes a recess or groove 40 located between a proximal end of the sound port 25*c* and a tapered cone portion proximate the free end of the sound port 25*c*. In some instances, the recess or groove 40 may extend continuously around the entire perimeter or circumference of the sound port 25*c*. However, in other instances, the recess or groove 40 may extend discontinuously around only a portion of the perimeter or circumference of the sound port 25*c*. The sound port 25*c* may generally extend away from the housing 23*c* toward a sound port opening 28*c* at a free end of the sound port 25*c*. The sound port 25*c* may have a length 31*c* (measured from a proximal end of the sound port 25*c*, attached to the housing 23*c*, to a free end of the sound port 25*c* along the central longitudinal axis of the sound port 25*c*) and a width or diameter 32*c* (measured perpendicular to the length 31*c*, and thus the central longitudinal axis). However, the base of the recess or groove 40 of the sound port 25*c* may have a reduced width, represented by width or diameter 36, which is less than the width 32*c*. In at least some of these embodiments, the housing 23*c* may include an extension 42 that connects to the sound port 25*c*. As depicted in FIG. 2C, the extension 42 may have a greater width or diameter than both the width 32*c* of the sound port 25*c* and the width 36 of the base of the recess or groove 40.

The sound port 25*c* may further include a tapered portion or cone proximate the free end of the sound port 25*c*. For instance, as seen in FIG. 2C, the sound port 25*c* may include a tapered portion extending between the recess or groove 40 and the free end of the sound port 25*c*. The tapered portion or cone may taper to a smaller diameter as it extends away from the recess or groove 40 toward the free end of the sound port 25*c*. For example, the cone or tapered portion of the sound port 25*c* may have a width 32*c* proximate the recess or groove 40 and a width 35 proximate the free end (e.g., proximate the sound port opening 28*c*) which is less than the width 32*c*. The length 37 depicted in FIG. 2C is the length of the cone or tapered portion of the sound port 25*c*.

In yet another embodiment, FIG. 2D depicts another exemplary sound port 25*d* and connected to an exemplary housing 23*d*. The sound port 25*d* may be categorized as an "undercut sound port." As with the sound port 25*c* of FIG. 2C, the sound port 25*d* also includes a recess or groove 41. In some instances, the recess or groove 41 may extend continuously around the entire perimeter or circumference of the sound port 25*d*. However, in other instances, the recess or groove 41 may extend discontinuously around only a portion of the perimeter or circumference of the sound port 25*c*. The sound port 25*d* may generally extend away from the housing 23*d* toward a sound port opening 28*d* at a free end of the sound port 25*d*. The sound port 25*d* may have a length 31*d* (measured from a proximal end of the sound port 25*d*, attached to the housing 23*d*, to a free end of the sound port 25*d* along the central longitudinal axis of the sound port 25*d*). The sound port 25*d* may include a first portion (e.g., cylindrical portion) having a length 39 and a width or diameter 32*d* (measured perpendicular to the length, and thus the central longitudinal axis) and a second portion forming the recess or groove 41 that has a width or diameter 38 (measured perpendicular to the length, and thus the central longitudinal axis). As can be seen, the width 38 is less than width 32*d*. Additionally, in some embodiments, the housing 23*d* may include an extension 43 that connects to the sound port 25*d*. As depicted in FIG. 2D, the extension 43 may have a greater width or diameter than both of the width 32*d* of the cylindrical portion of the sound port 25*d* and the width 38 of the base of the recess or groove 41.

In general, the widths or diameters 32*a*-32*d* for sound ports 25*a*-25*d* may range from about 2.5 mm (0.10 inches) to about 7.6 mm (0.30 inches), and in other embodiments, the widths 32*a*-32*d* may be even greater than 7.6 mm (0.30 inches). Additionally, lengths 31*a*-31*d* may generally be greater than the width 32*a*-32*d* of the respective sound ports 25*a*-25*d*. For instance, the ratio of width 32*a*-32*d* to length 31*a*-31*d* of the sound port 25*a*-25*d* may be about 0.75 or less, about 0.65 or less, or about 0.55 or less, in some instances. However, in some embodiments, the ratio of width 32*a*-32*d* to length 31*a*-31*d* may approach 1 and or exceed 1 (e.g., the width 32*a*-32*d* may be equal to or approximately equal to the length 31*a*-31*d*). Absent the use of an earphone tip specifically dimensioned and designed to fit a designated sound tube it is readily apparent that a mismatch may provide inadequate tip retention in use.

Figure 3:
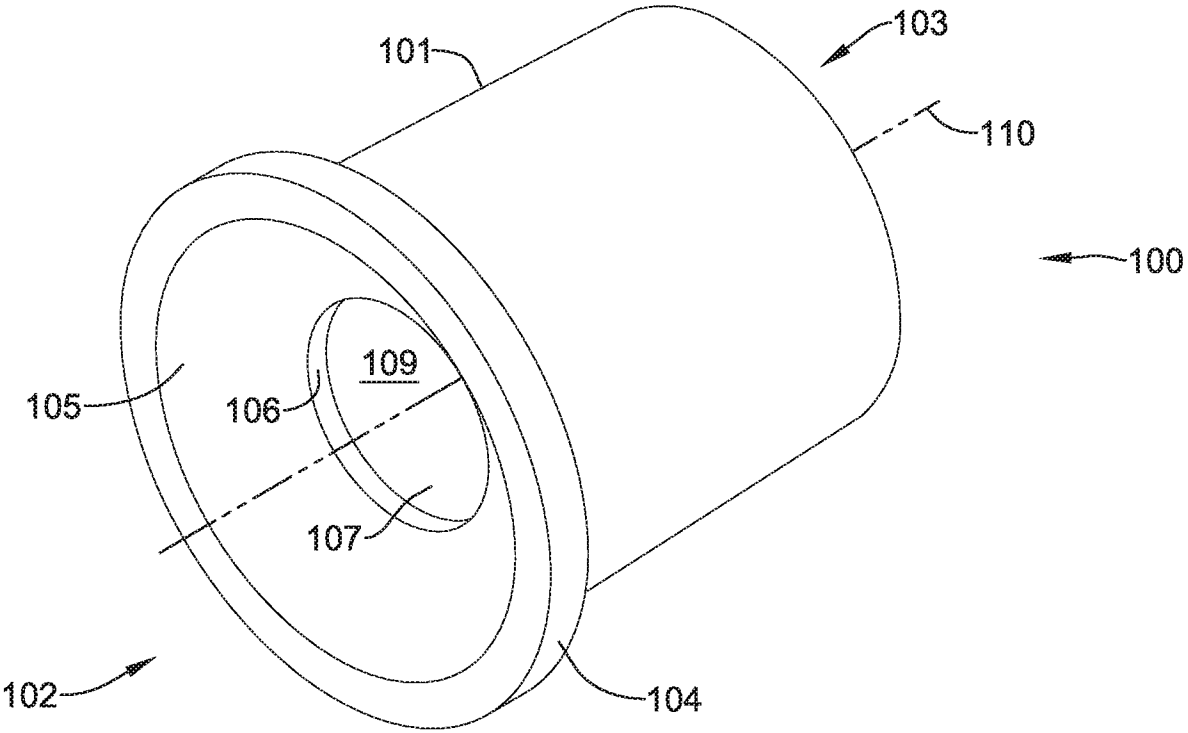
FIG. 3 is a perspective view of an adapter of the present disclosure.

FIG. 3 is a perspective view of a universal sound port core or adapter 100 for use with a removable/replaceable earphone tip for a sound device that provides a sturdy yet detachable connection to a wide range of sound ports. The core or adapter 100 may be configured to connect securely to any one of a plurality of different sound port configurations of an earbud-type sound device or other sound device. For example, the core or adapter 100 may be configured to connect securely to at least each of the sound ports depicted in FIGS. 2A-2D so that individual earphone tips do not need to be designed specifically for each sound port having a different connection feature.

Generally, the core or adapter 100 may include a body 101 that extends along a central longitudinal axis 110 from a first, proximal end 102 (at the base of the core 100) to a second, distal end 103 (at the tip of the core 100). In some embodiments, the body 101 may generally have a cylindrical shape. However, in other embodiments, the body 101 may have any desirable shape, such as rectangular, ovoid, conic, or the like. In some embodiments, as described below, the core 100 includes a proximal portion that provides structure and material properties for allowing insertion of a wide range of radial diameter sound ports and a distal portion that includes structure for retaining the core 100 on sound ports having different outside surface features as previously described with respect to FIGS. 2A-2D, above.

In some embodiments, the body 101, at the proximal end 102, may include a flange 104 extending radially outward from a main portion of the body 101. The flange 104 may be wider (e.g., have a greater diameter) than the remainder of the body 101 (e.g., the main portion of the body 101. The adapter or core 100 may include lead-in face 105 radially inward of the flange 104 proximate the proximal end 102 of the adapter 100. Lead-in face 105 may comprise a surface that tapers inwardly from the flange 104 toward a center of the body 101 and the central longitudinal axis 110 in a direction from the proximal end 102 toward the distal end 103 of the core 100. The lead-in face can be a feature of the proximal portion of the core 100 that aids in insertion of a wide range of outer diameters found on sound tube. In some embodiments, as shown in FIG. 3, the lead-in face 105 may slope radially inward away from the proximal end 102 toward the distal end 103 as the lead-in face 105 extends inward, terminating at an internal rim 106 that is a structural feature of the distal portion of the core 100 that provides earphone tip retention for a wide variety of outer surface features of sound tubes. The internal rim 106 may define an opening 107 that leads to a lumen 109 defined by the main portion of the body 101. In this configuration, the lead-in face 105 may define an outline of a frustoconical shape between the proximal end 102 and the opening 107. The internal rim 106 may extend continuously or discontinuously around the interior of the adapter 100, as described in more detail below with respect to alternative embodiments.

Figure 4:
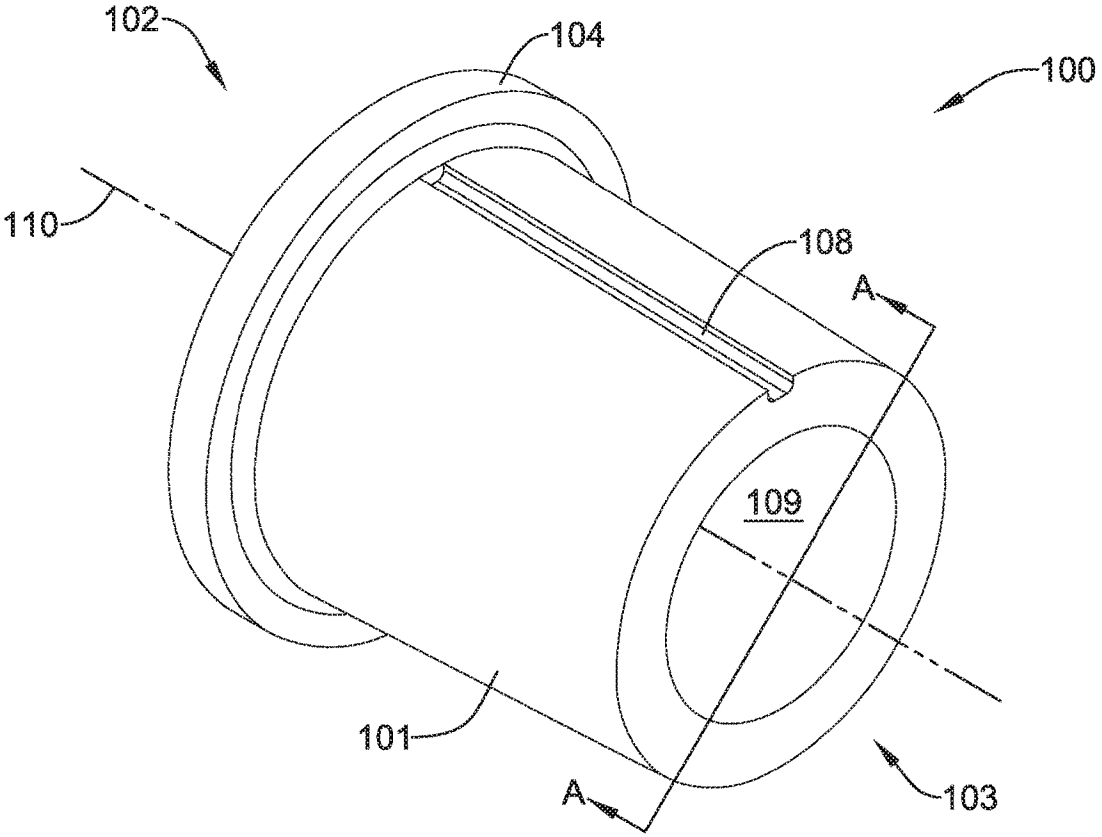
FIG. 4 is a another perspective view of an adapter of the present disclosure including a groove.

FIG. 4 depicts another perspective view of the adapter 100. As can be seen in FIG. 4, in some embodiments, the body 101 may include a longitudinally extending groove 108 extending into the main portion of the body 101 from an exterior surface of the main portion of the body 101 to the adapter 100. The groove 108 may weaken one or more mechanical features of the body 101 such that the body 101 may flex more easily (e.g., radially expand) when forces are applied to the sides of the body 101 or to the flange 104 (e.g., when a sound port positioned in the lumen 109 exerts a radially outward force on the interior surface of the main portion of the body 101 defining the lumen 109 and/or the internal rim 106. This feature may make it easier to connect and disconnect the adapter 101 from a sound port, such as those described with respect FIGS. 2A-2D.

Figure 5:
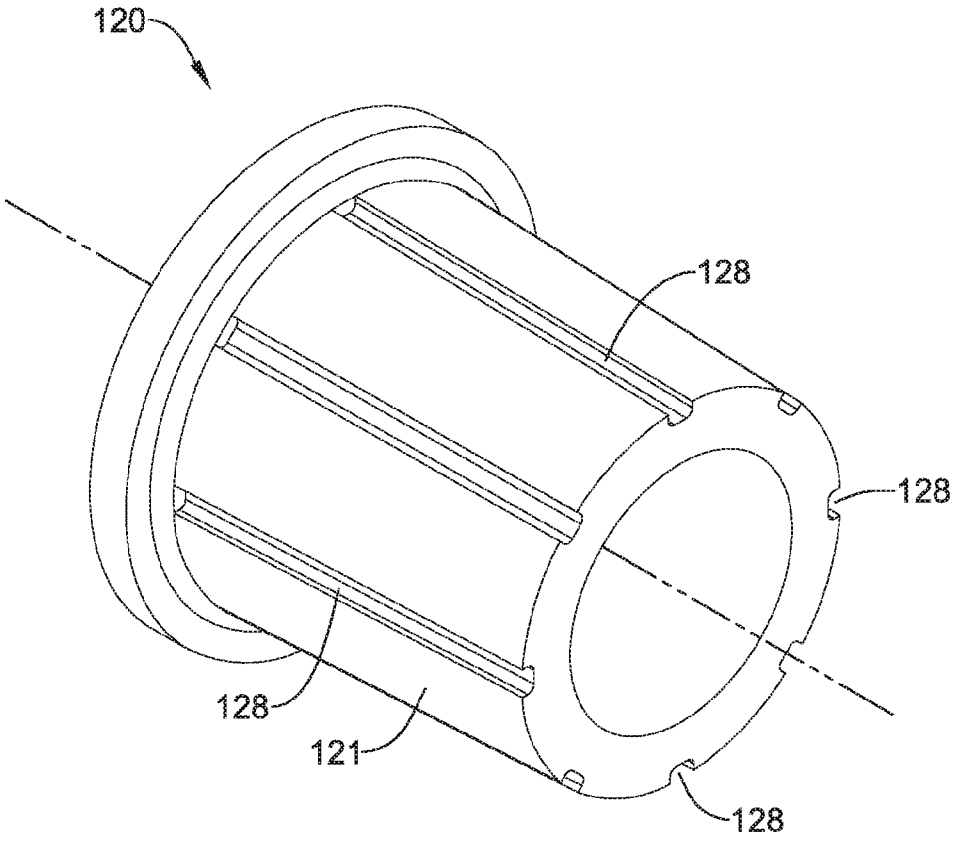
FIG. 5 is a another perspective view of an adapter of the present disclosure including multiple grooves.

Of course, although shown in FIG. 4 as only including a single longitudinal groove 108, in other embodiments, the body 101 may include a plurality longitudinal grooves 108 symmetrically or asymmetrically arranged around the periphery or circumference of the main portion of the body 101 of the adapter 100. As one example, the body 101 may include two longitudinal grooves 108 that are situated on opposite sides of the body 101. FIG. 5 depicts another sound port adapter 120 including additional longitudinal grooves 128. The embodiment of FIG. 5 depicts eight separate longitudinal grooves 128 spaced around the circumference of the body 121. However, this is just one example. In general the sound port adapter 100 or 120 may include any number of longitudinal grooves, as desired. Generally, the more longitudinal grooves implemented on the body 101, 121 of an adapter 100, 120 of the present disclosure, the more easily the body 101, 121 of the adapter 100, 120 may flex and/or radially expand when forces (e.g., radially outward forces) are applied to the body 101, 121.

Figure 6:
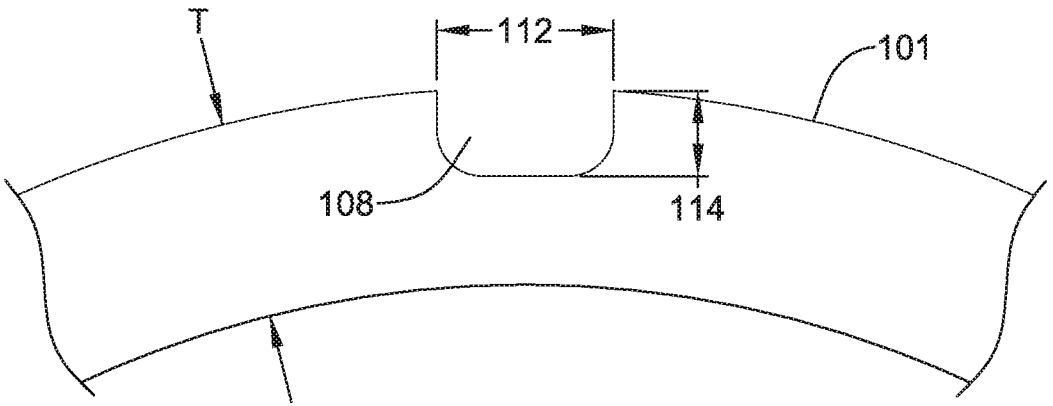
FIG. 6 is a plan view of an exemplary groove include groove dimensions.

FIG. 6 depicts a cross-section of a portion of the body 101 including a longitudinal groove 108 showing relative dimensions between the cylindrical wall of the body 101 and the groove 108. It is noted that discussion of the groove 108 of FIG. 6 would also be applicable to the grooves 128 of the embodiment of FIG. 5, and other embodiments including grooves disclosed herein. In different embodiments of the present disclosure, the dimensions of the groove 108, or the dimensions of each of multiple grooves in embodiments that include multiple grooves (e.g., the embodiment of FIG. 5), may be different relative to the dimensions of the body 101. For instance, in some instances the width 112 of the groove 108 may be between about 0.001 inch to about 0.050 inch, about 0.010 inch to about 0.050 inch, about 0.010 inch to about 0.30 inch, about 0.015 inch to about 0.025 inch, or about 0.02 inches. However, in still further embodiments, the width 112 of the groove 108 may extend the majority of the circumference of body 101 such that the width 112 of the groove 108 is between 50% and 95% percent of the circumference of body 101, for example. Similarly, in embodiments that include multiple grooves, the width 112 of each groove 128 (measured in a circumferential direction) may range anywhere between 0.5% and 50%, between 0.5% and 40%, between 0.5% and 30%, between 0.5% and 20%, between 0.5% and 10%, between 1% and 50%, between 1% and 40%, between 1% and 30%, between 1% and 20%, between 1% and 10%, between 2% and 50%, between 2% and 40%, between 2% and 30%, between 2% and 20%, between 2% and 10%, between 5% and 50%, between 5% and 40%, between 5% and 30%, between 5% and 20%, or between 5% and 10%, of the circumference of the main portion of the body 101 in some instances. Additionally or alternatively, the combined width of all of the grooves 128 may range between 5% and 95%, between 5% and 80%, between 5% and 70%, between 5% and 50%, between 10% and 75%, between 10% and 50%, between 20% and 75%, or between 20% and 50% of the circumference of the main portion of the body 101, for example. As with the number of grooves, the width chosen for a groove or a plurality of grooves may affect the mechanical properties of the body 101. For instance, generally, the greater the width of a groove, or the greater the combined width of all included grooves, the more flexibility the body 101 may have.

Depth 114 (measured in a radial direction perpendicular to the central longitudinal axis 110) in FIG. 6 defines how deep groove 108 may extend into the wall of the body 101 from the outer peripheral surface of the main portion of the body 101. In some instances, the depth 114 may be between 0.1 mm (0.004 inches) to 0.5 mm (0.020 inches), between 0.1 mm (0.004 inches to 0.25 mm (0.010 inches), between 0.05 mm (0.002 inches) to 0.5 mm (0.020 inches), or 0.05 mm (0.002 inches) to 0.5 mm (0.020 inches). In different embodiments, depth 114 may range from between 5% to 95%, between 5% to 75%, between 5% to 50%, between 10% to 75%, between 10% to 50%, between 10% to 40%, between 10% to 30%, between 10% to 20%, between 20% to 40%, between 20% to 30%, about 10%, about 20%, or about 30% of the wall thickness T (measured in a radial direction perpendicular to the central longitudinal axis 110) of body 101, for example. The specific depth 114 chosen may affect the mechanical properties of the body 101. For instance, generally, the greater the depth 114, the more flexible the body 101 may be.

It is noted that in other embodiments the groove(s) 108 may extend into the wall of the body 101 from the inner peripheral surface of the main portion of the body 101 toward the outer peripheral surface of the main portion of the body 101, if desired.

Figure 7A:
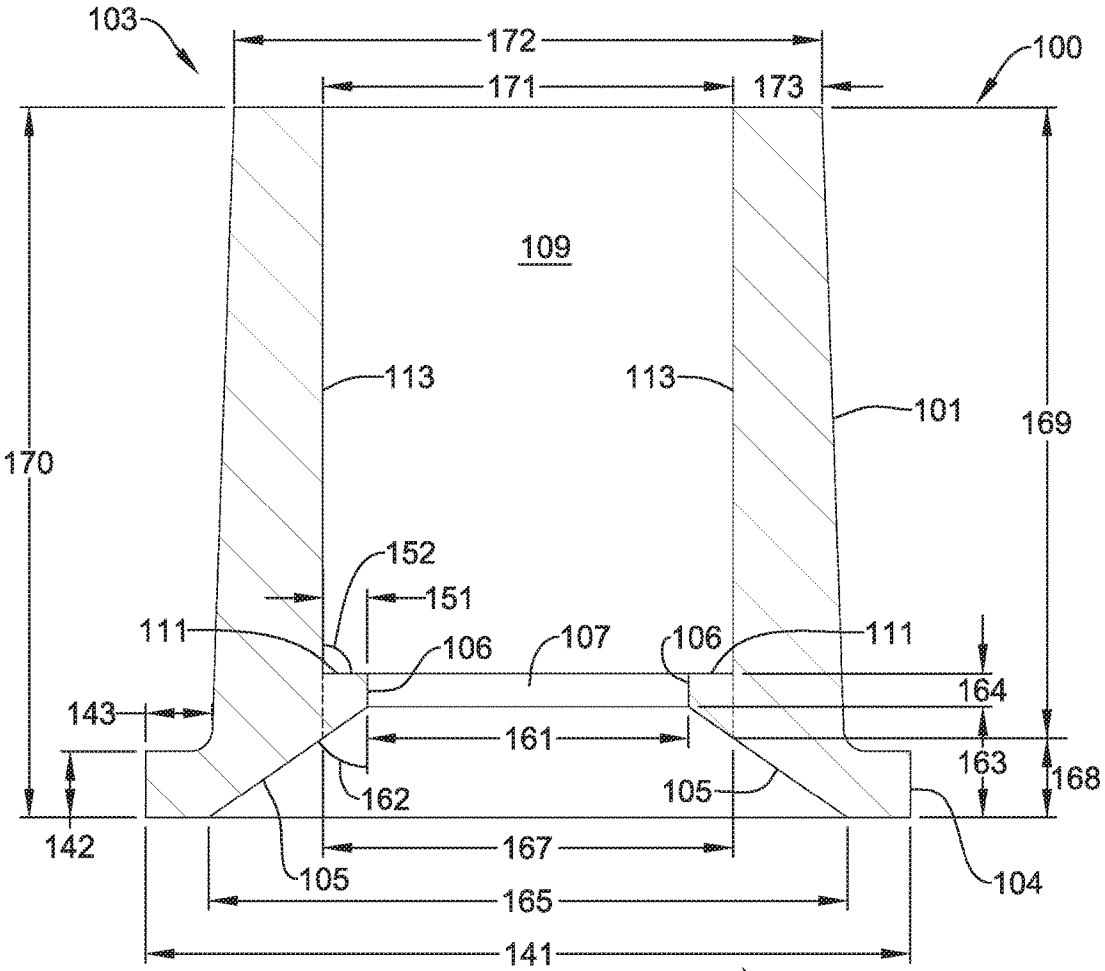
FIG. 7A is a cross-section view of the adapter of FIG. 3 as viewed along line A-A of FIG. 4.
Figure 7B:
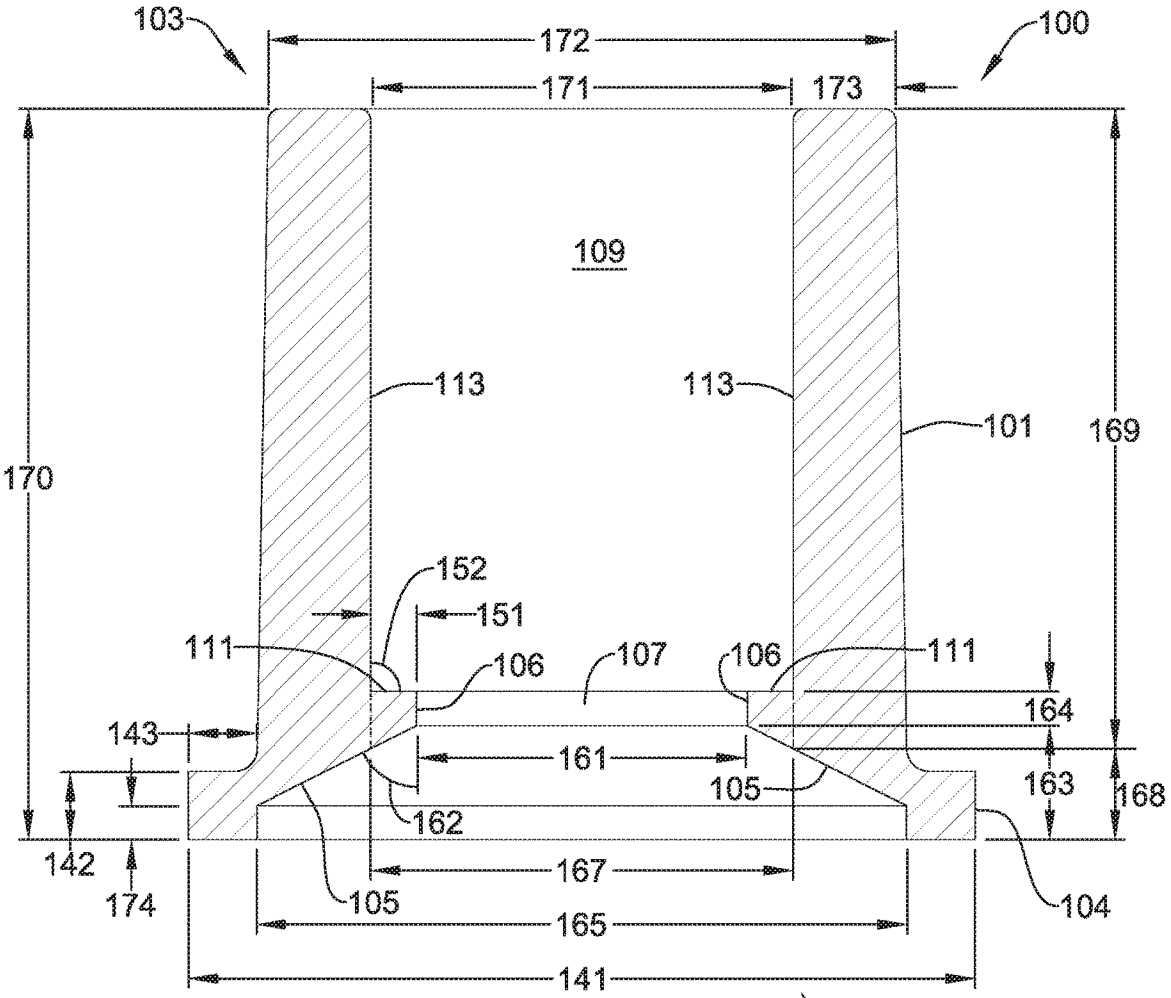
FIG. 7B is a cross-section view of an alternative design of the adapter of FIG. 3 as viewed along line A-A of FIG. 4.
Figure 7C:
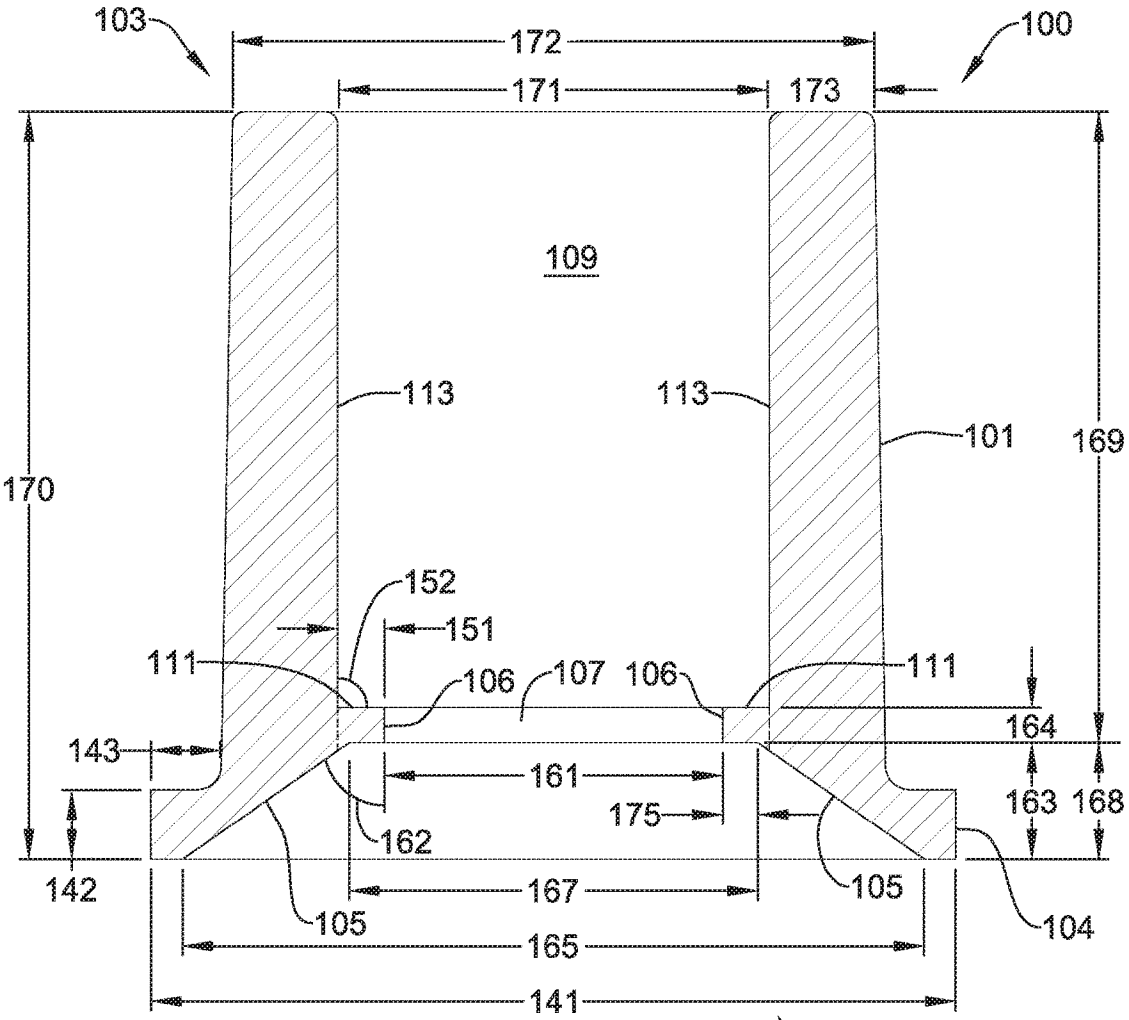
FIG. 7C is a cross-section view of an alternative design of the adapter of FIG. 3 as viewed along line A-A of FIG. 4.
Figure 7D:
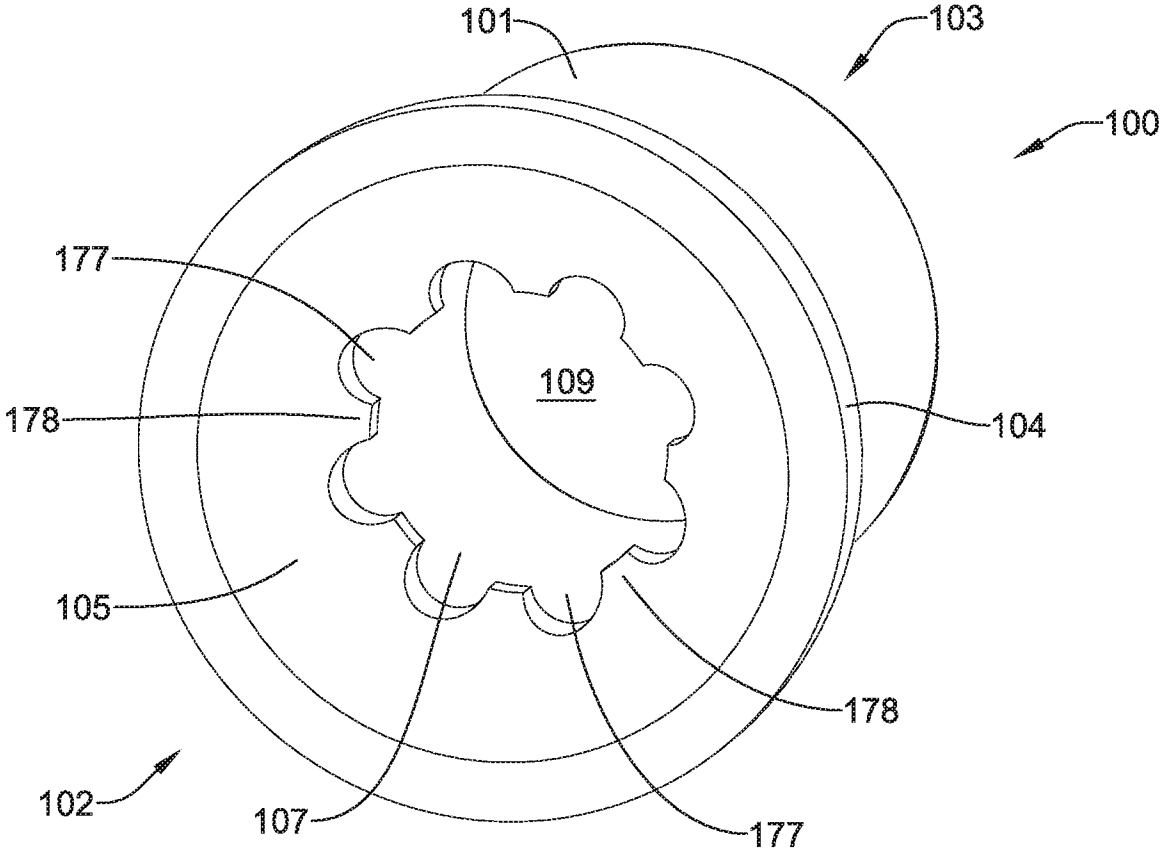
FIG. 7D is another perspective view of an adapter of the present disclosure including alternative retention members.
Figure 7E:
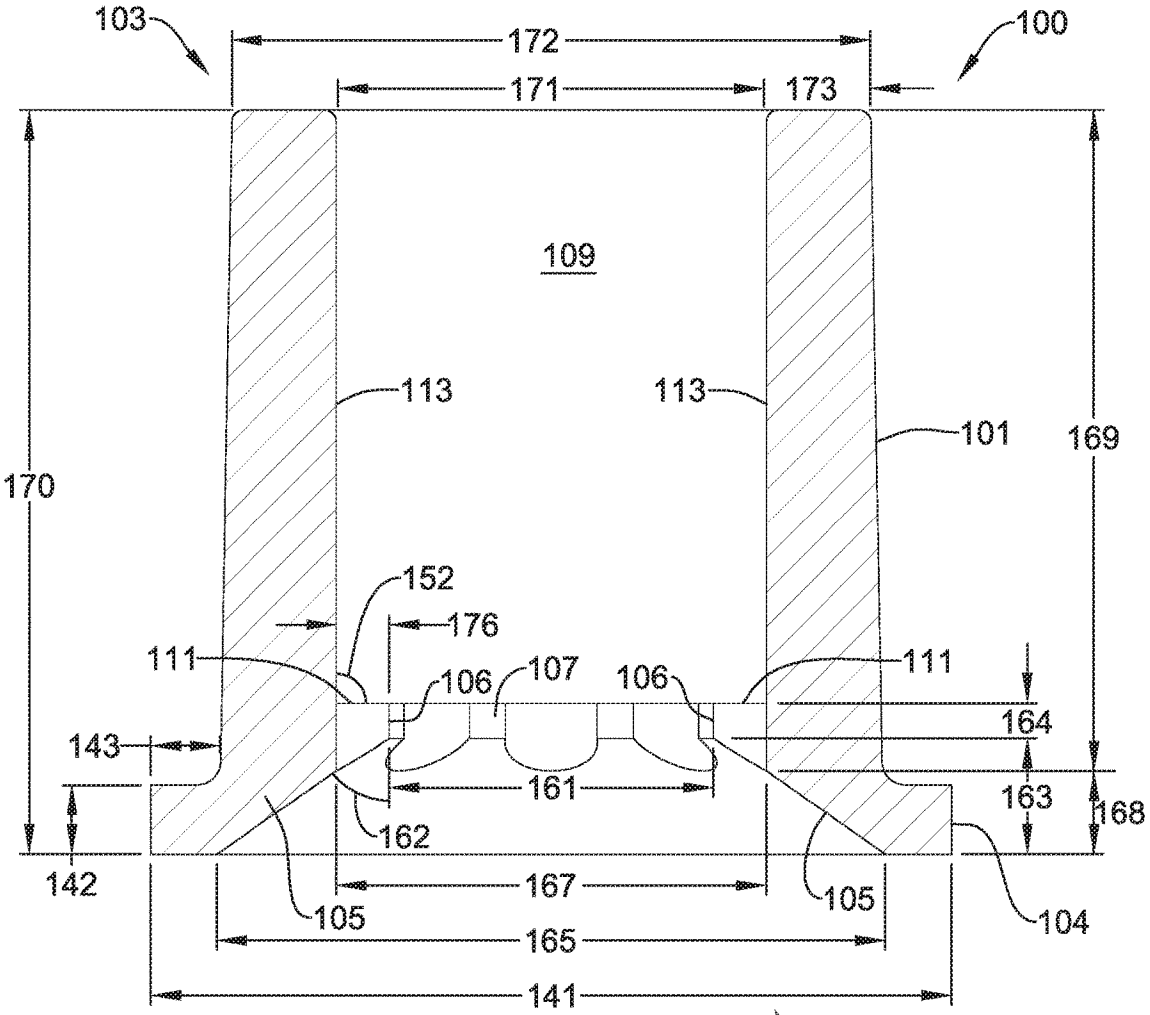
FIG. 7E is a cross-section view of the adapter of FIG. 7D.
Figure 7F:
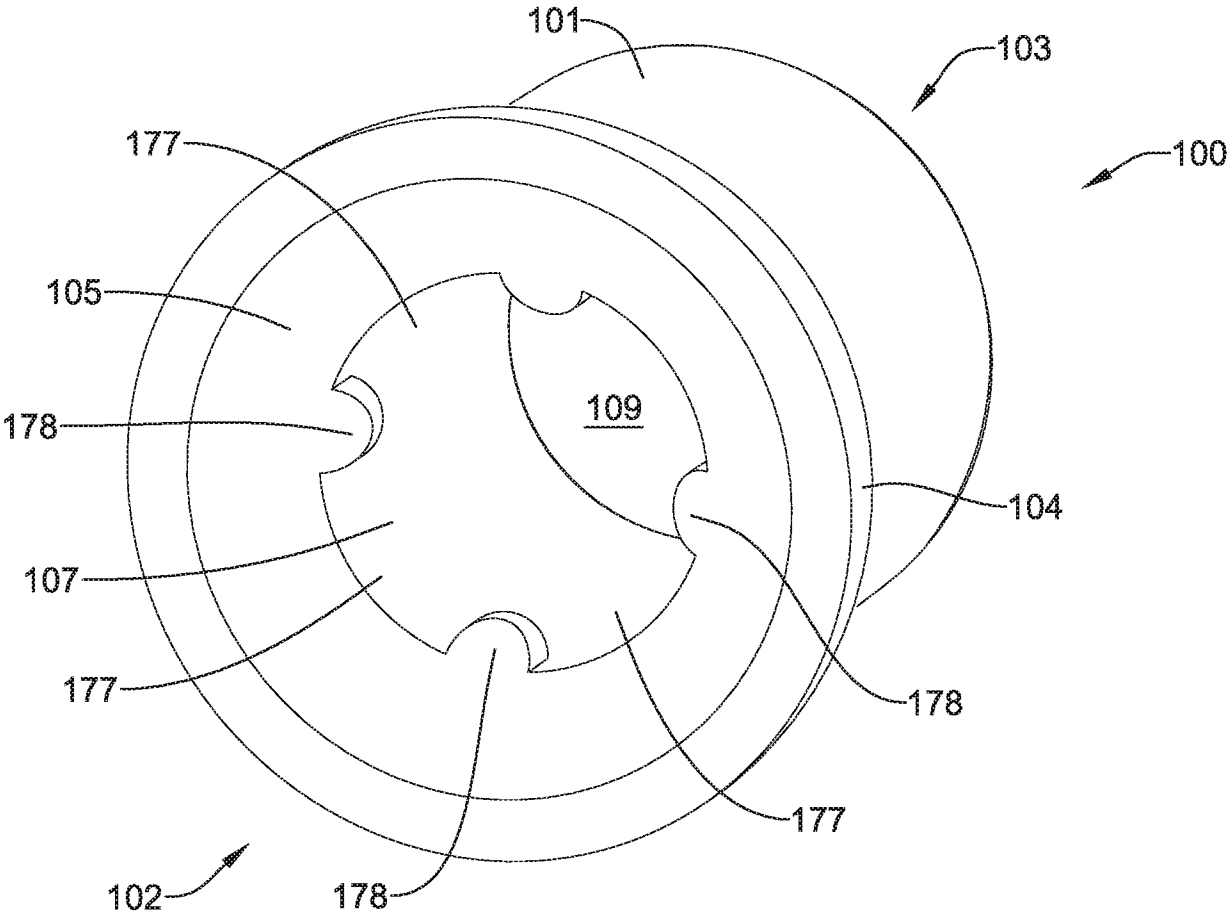
FIG. 7F is another perspective view of the adapter of the present disclosure including another alternative design for retention members.
Figure 7G:
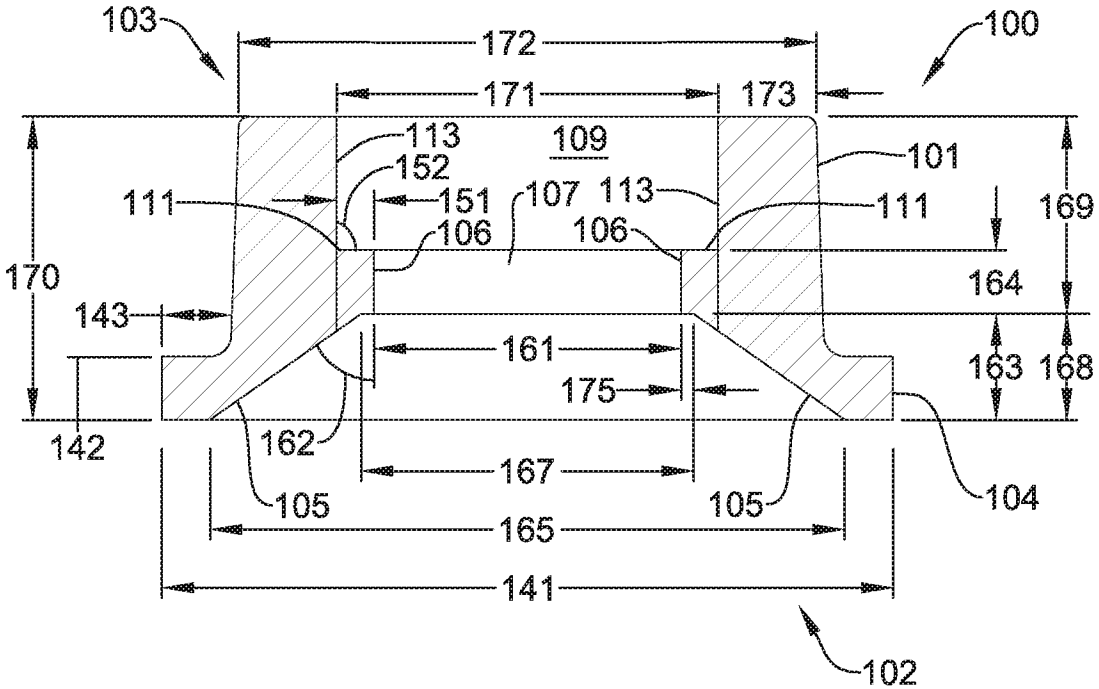
FIG. 7G is a cross-section view of an alternative design of the adapter of FIG. 3.

FIGS. 7A-H each depict an exemplary perspective or cross-section of alternative designs of adapter or core 100 of FIG. 3 or FIG. 4 as viewed along line A-A, including various embodiments and dimensions of the adapter 100. The views of FIGS. 7A, 7B, 7C, 7E and FIG. 7G provide features that delineate a proximal portion 168 of the core 100 and a distal portion 169 of the core 100 that make ear tips incorporating these features a universal design for detachably coupling to a wide range of sound tube designs. In general, width 141 may define the overall width (e.g., diameter) of the adapter 100 at the proximal end 102, while width 172 may define the overall width (e.g., diameter) of the adapter 100 at the distal end 103. Generally, the width 141 may be greater than the width 172, as the proximal end 102 may include the flange 104. Thus, in some instances the width 141 may be the outer diameter of the flange 104 at the proximal end 102. In the embodiment of FIG. 7G, the overall width 141 at the proximal end 102 may be about 8.5 mm (0.33 inches) to about 9.0 mm (0.35 inches), or about 8.75 mm (0.34 inches), while the overall width 172 at the distal end 103 may be about 6.5 mm (0.25 inches) to about 7.5 mm (0.30 inches), or about 7.0 mm (0.275 inches), for example.

Additionally, the body wall thickness 173 represents the thickness of the wall of body 101 and may generally range anywhere between about 0.38 mm (0.015 inches) to about 1.27 mm (0.050 inches), and more specifically between about 0.51 mm (0.020 inches) to about 1.02 mm (0.040 inches). In some embodiments, as depicted in FIGS. 7A, 7B, 7C, 7E and 7G, the exterior surface of the main portion of the body 101 of the adapter 100 may taper from a first, larger diameter proximate the proximal end 102 to a second, smaller diameter proximate the distal end 103. Additionally or alternatively, the interior surface 113 of the main portion of the body 101 of the adapter 100 defining the lumen 109 may have a constant diameter or may taper from a first diameter proximate the proximal end 102 to a second diameter proximate the distal end 103. The first diameter of the interior surface 113 may be greater than or less than the second diameter of the interior surface 113, as desired. In such embodiments, the value of the wall thickness of the body 101 may vary as well from a larger wall thickness near the proximal end 102 to a smaller wall thickness 173 at the distal end 103.

Flange width 143 may represent the width of flange 104 as it extends radially outward from the exterior surface of the main portion of the body 101. The flange width 143 may be between about 0.2 mm (0.008 inches) to about 2 mm (0.079 inches), between about 0.4 mm (0.016 inches) to about 2 mm (0.079 inches), or between about 0.5 mm (0.020 inches) to about 1 mm (0.039 inches), in some instances. In the embodiment of FIG. 7G, the flange width 143 may be about 0.6 mm (0.02 inches) to about 1.0 mm (0.04 inches), or about 0.8 mm (0.03 inches), for example.

Additionally, flange 104 may have a flange height 142, while the adapter 100 has an overall body height 170. In some instances, the flange height 142 may be between about 0.2 mm (0.008 inches) to about 2 mm (0.079 inches), between about 0.4 mm (0.016 inches) to about 2 mm (0.079 inches), or between about 0.5 mm (0.020 inches) to about 1 mm (0.040 inches). In some instances, the flange height 142 may be 1.2 mm (0.047 inches) or less, 1.1 mm (0.043 inches) or less, 1.0 mm (0.040 inches) or less, 0.9 mm (0.035 inches) or less, 0.8 mm (0.032 inches) or less, or 0.7 mm (0.028 inches) or less. In the embodiment of FIG. 7G, the flange height 142 may be about 0.6 mm (0.02 inches) to about 0.9 mm (0.04 inches), or about 0.75 mm (0.03 inches), for example. In some instances, the overall body height 170 may be between about 3 mm (0.118 inches) to about 16 mm (0.630 inches), between about 5 mm (0.197 inches) to about 12 mm (0.472 inches), between about 7 mm (0.276 inches) to about 10 mm (0.394 inches), or between about 7 mm (0.276 inches) to about 8 mm (0.315 inches). In the embodiment of FIG. 7G, the overall height 170 may be about 3.5 mm (0.138 inches) to about 3.7 mm (0.146 inches), or about 3.65 mm (0.144 inches), fore example. As with flange width 143, in different embodiments, the relation between the flange height 142 and the overall body height 170 may differ.

In each of the embodiments depicted in FIGS. 7A-H, the core or adapter 100 includes a lumen 109 extending from the proximal end to the distal end thereof. The walls defining this lumen and the materials used to form the core 100 include elements that allow the positioning and detachable retention of the ear tip onto sound tubes having a wide range of sizes and shapes. Further, the walls defining the lumen 109 include other elements that aid in adequately retaining the ear tip for a wide range of sound tube sizes and shapes. The core or adapter 100 includes a proximal portion 168 having a lead-in face 105 and a distal portion 169 having a proximally located retention member and or members 106. The combination of these features can make the core 100 and associated ear tip a universal fit for current ear phones having various sound tube design features and sizes.

Referring specifically to FIG. 7A, the proximal portion 168 of the core 100 can extend from the proximal end 102 distally a length of about 0.5 mm. to about 1.5 mm. The lead-in face 105, which can aid in positioning sound tubes of various size and design within the lumen 109, is included in the proximal portion 168. As mentioned previously, at the proximal end 102, the lead-in face 105 may taper or slope radially inwardly from the proximal end 102 toward the distal end 103. Accordingly, the lead-in face 105 may define an opening that has a width 165 at the proximal end 102 and tapers toward the distal end 103 to an intermediate width 167, which in the embodiment of FIG. 7A marks the distal end of the proximal portion 168. As shown in the illustrated embodiment, the width 167 along the face 105 may be the same as the width 171 of the lumen 109 in the distal portion 169 described below. In the embodiment of FIG. 7A, the lead-in face 105 continues to taper inward in the distal portion 169 down to opening 107, which has a width 161. In some embodiments, width 165 can be from about 4.3 mm (0.170 inches) to about 8.40 mm (0.330 inches), while width 167 can be about 2.79 mm (0.10 inches) to about 5.08 mm (0.20 inches), and width 161 can be about 2.0 mm (0.079 inches) to about 4.1 mm (0.161 inches). In different embodiments, width 161 and width 165 may be related in different fashions.

Additionally, as the lead-in face 105 extends radially inwardly and toward the distal end 103, the lead-in face 105 may form an angle 162 with respect to the central longitudinal axis of the body 101. Alternatively, the lead-in face 105 can be defined in terms of the length axially over which the reduction in diameter decreases. Width 165 can reduce to width 161 over an axial length (length 163 in FIG. 7A) of about 0.8 mm (0.032 inches) to about 1.5 mm (0.059 inches). In different embodiments, angle 162 may range anywhere between about 30° to about 60°, between about 30° to about 50°, between about 40° to about 60°, or between about 40° to about 50°, for example. The specific value chosen for the axial length over which the diameter or width is reduced or the angle 162 may affect how easily adapter 100 may connect to a sound port and/or may affect the largest size of sound tube the earphone tip having the adapter 100 may reasonably accept. The lead-in face 105 can include a linear surface or a curved surface to achieve its function which is to direct the sound tube gradually into the lumen 109 while stretching or expanding the core material to receive the sound tube therein.

Also as mentioned previously, the distal portion 169 of the lumen 109 can include a defining surface that has one or more retention members projecting radially inward from the lumen wall. In the embodiment of FIG. 7A, the retention member is defined on the proximal side by the continued reduction in diameter of the lead-in face from diameter 167 to diameter 161. As indicated, the opening 107 can be defined by an internal rim 106 extending radially inward from the interior surface 113 of the wall of the main portion of the body 101 defining the lumen 109 in the distal portion 169. In some embodiments, the wall of the distal portion 169 defining the lumen 109 can include a diameter or width of about 2.8 mm (0.110 inches) to about 5.08 mm (0.20 inches). Internal rim 106, which is disposed a distance away from interior surface 113, may form a shoulder 111 facing the distal end 103 of the body 101. The shoulder 111 may be configured to engage a surface or feature of a sound port to facilitate retention of the adapter 100 on the sound port. For example, the shoulder 111 may engage a surface of an annular barb or recess of a sound port to provide an interference fit therebetween.

Referring now to the embodiment depicted in FIG. 7B, an alternative design for the proximal portion 168 is depicted. In this embodiment, the proximal end width 165 of the lumen 109 extends distally with a constant diameter (i.e., is cylindrical) for a portion of the proximal section 168 before beginning to taper inwardly to form the lead-in face 105. Thus, the proximal end of the lead-in face 105 is recessed distally from the proximal end 102 of the adapter 100.

Referring now to the embodiment depicted in FIG. 7C, another alternative design for the retention member in the distal portion 169 is depicted. In this embodiment, the retention member proximal side is not formed by a continuing taper of the lead-in face 105. Instead, the lead-in face 105 of the proximal portion 168 ends at width 167 and the retention member is then formed by a rim projecting radially inward on both its proximal and distal side to form an annular rim or shoulder.

Another alternative embodiment may combine the features of the proximal portion 168 of FIG. 7B (having a proximal end of the lead-in face 105 recessed distally from the proximal end 102 of the adapter 100) and the features of the retention member in the distal portion 169 of FIG. 7C (proximal face of the retention member 106 not formed by a continuing taper of the lead-in face 105, but rather a radially inward projecting surface).

FIGS. 7D-7F depict alternative retention member designs. In previous embodiments the retention members were depicted as a continuous annular rim that projects radially inward within the lumen 109 to contact the sound tube or fit within a notch or groove in the sound tube. Alternatively, the retention member can be a discontinuous rim, such as a plurality of radially inwardly projecting fingers or sections 178 around the circumference with a cut-out or notch 177 between adjacent fingers 178, rather than a continuous shoulder. The number of fingers, cut-outs or notches can vary in alternative embodiments. The fingers 178 in the distal portion 169 of the lumen 109 in 7D-7F can extend a radial distance 176 inward from interior surface 113 between greater than 0.0 mm to about 1 mm in some instances, however; they should not be larger than dimension 151, described herein. For instances, the radial dimension 176 of the fingers 178 may range between about 0.125 mm (0.005 inches) to about 1.5 mm (0.060 inches), and more specifically between about 0.125 mm (0.005 inches) to about 0.75 mm (0.030 inches), in some embodiments. It is contemplated that the adapter 100 may include a single cut-out 177 or a plurality of cut-outs 177. These cut-outs 177 between fingers 178 could be of various sizes, such as a slit in the material between adjacent fingers 178 to encompassing a large percentage of the rim, as illustrated in 7F.

Referring now to the embodiment depicted in FIG. 7G, another alternative design for the retention member in the distal portion 169 is depicted. The core or adapter 100 includes a proximal portion 168 having a lead-in face 105 and a distal portion 169 having a proximally located retention member and or members 106, such as a radially inwardly projecting rim. The lead-in face 105 may taper or slope radially inwardly from the proximal end 102 toward the distal end 103. The combination of these features can make the core 100 and associated ear tip a universal fit for current ear phones having various sound tube design features and sizes. In this embodiment, the lead-in face 105 of the proximal portion 168 ends at width 167 and the retention member is then formed by a rim projecting radially inward on both its proximal and distal side to form an annular rim or shoulder. The embodiment of FIG. 7G is similar in many respects to the embodiment of FIG. 7C. However, the overall height 170, which may be attributed to a reduction in the length of the distal portion 169, may be less than the overall height 170 of the embodiment of FIG. 7C. In the embodiment of FIG. 7G, the overall height 170 may be about 3.5 mm (0.138 inches) to about 3.7 mm (0.146 inches), or about 3.65 mm (0.144 inches), wherein the distal portion 169 may have a height of about 2.3 mm (0.091 inches) to about 2.5 mm (0.098 inches), or about 2.4 mm (0.094 inches), and the proximal portion 168 may have a height of about 1.2 mm (0.047 inches) to about 1.4 mm (0.055 inches), or about 1.3 mm (0.051 inches).

The lead-in face 105 may define an opening that has a width 165 at the proximal end 102 and tapers toward the distal end 103 to an intermediate width 167, which in the embodiment of FIG. 7G marks the distal end of the proximal portion 168. The proximally facing surface 175 of the retention member 106 (e.g., annular rim), may be located at the junction between the proximal portion 168 and the distal portion 169. The annular rim of the retention member 106 may extend radially inward on both its proximal and distal sides. The lumen 109 of the distal portion 169 can have a diameter 171 of about 4.4 mm (0.17 inches) to about 4.8 mm (0.19 inches), or about 4.6 mm (0.18 inches). Internal rim 106, which is disposed a distance away from interior surface 113, may form a shoulder 111 facing the distal end 103 of the body 101. The shoulder 111 may be configured to engage a surface or feature of a sound port to facilitate retention of the adapter 100 on the sound port. For example, the shoulder 111 may engage a surface of an annular barb or recess of a sound port to provide an interference fit therebetween.

Additionally, the lead-in face 105 may form an angle 162 with respect to the central longitudinal axis of the body 101. The angle 162 may be about 50° to about 60°, or about 55°, for example. The specific value chosen for the axial length over which the diameter or width is reduced or the angle 162 may affect how easily adapter 100 may connect to a sound port and/or may affect the largest size of sound tube the earphone tip having the adapter 100 may reasonably accept. The lead-in face 105 can include a linear surface or a curved surface to achieve its function which is to direct the sound tube gradually into the lumen 109 while stretching or expanding the core material to receive the sound tube therein.

In the embodiment of FIG. 7G, width 165 can be from about 7.0 mm (0.275 inches) to about 8.0 mm (0.315 inches), or about 7.6 mm (0.300 inches), while width 167 can be about 3.5 mm (0.138 inches) to about 4.5 mm (0.178 inches), or about 4.0 mm (0.157 inches), and width 161 can be about 3.5 mm (0.138 inches) to about 4.0 mm (0.157 inches), or about 3.7 mm (0.146 inches).

The internal rim 106 depicted in FIGS. 7A, 7B, 7C, 7E and 7G, or other retention members, may have a height 164, and in different embodiments the height 164 may range anywhere between about 0.125 mm (0.005 inches) to about 1.0 mm (0.040 inches), and more specifically between about 0.375 mm (0.015 inches) to about 0.635 mm (0.025 inches), or between about 0.635 mm (0.025 inches) to about 0.75 mm (0.030 inches), or about 0.75 mm (0.030 inches). However, in still other embodiments, the height 164 may be less than 0.125 mm (0.005 inches), greater than 1.0 mm (0.040 inches), or greater than 0.75 mm (0.030 inches). In the embodiment of FIG. 7G, the height 164 may be about 0.6 mm (0.02 inches) to about 0.9 mm (0.04 inches), or about 0.75 mm (0.03 inches), for example.

The shoulder 111 may extend a distance 151 radially inward from the interior surface 113. In different embodiments, the distance 151 may range between about 0.125 mm (0.005 inches) to about 1.5 mm (0.060 inches), and more specifically between about 0.125 mm (0.005 inches) to about 0.75 mm (0.030 inches) or between about 0.3 mm (0.01 inches) to about 0.5 mm (0.02 inches). However, in still other embodiments, the height 164 may be smaller than 0.125 mm (0.005 inches) or larger than 1.5 mm (0.060 inches).

The shoulder 111 may extend away from the interior surface 113 at an angle 152. As depicted in FIGS. 7A, 7B, 7C, 7E and 7G, the angle 152 may be 90°. However, in other embodiments, the angle 152 may range anywhere between about 30° to about 120°, between about 45° to about 100° between about 60° to about 120°, about 75° to about 105°, about 80° to about 100°, about 85° to about 95°, or another angle as desired. The specific value of the angle 152 may affect how adapter 100 connects to different sound ports. Another dimension depicted in FIGS. 7A, 7B, 7C, 7E and 7G is height 163. Height 163 represents the distance between the closest edge (proximal edge) of the distal portion of retention member or exemplary internal rim 106 to the proximal end 102. In some instances, the height 163 may be about 0.5 mm (0.020 inches) to about 2 mm (0.080 inches), about 0.75 mm (0.030 inches) to about 1.75 mm (0.070 inches), about 0.7 mm (0.028 inches), about 0.9 mm (0.035 inches), about 1.0 mm (0.040 inches), about 1.5 mm (0.060 inches), or about 1.6 mm (0.063 inches) for example. In the embodiment of FIG. 7G, the height 163 may be about 1.1 mm (0.04 inches) to about 1.5 mm (0.06 inches), or about 1.3 mm (0.05 inches), for example.

In some instances, the height 163 (i.e., the distance between the proximal end 102 and the closest edge (proximal edge) of the internal rim 106) may be different than the flange height 142. For instance, the height 163 may be greater than the flange height 142 in some embodiments such that the internal rim 106 is longitudinally offset distally from the flange 104. In other embodiments, the height 163 may be less than or equal to the flange height 142 such that the internal rim 106 and the flange 104 are coextensive and/or longitudinally overlap one another. In some instances, the flange 104 may be located proximal of yet 1.0 mm (0.040 inches) or less, 0.9 mm (0.035 inches) or less, 0.8 mm (0.031 inches) or less, 0.7 mm (0.028 inches) or less, 0.6 mm (0.024 inches) or less, or 0.5 mm (0.020 inches) or less from the proximal edge of the internal rim 106. In the embodiment of FIG. 7G, the height 142 may be about 0.6 mm (0.02 inches) to about 0.9 mm (0.04 inches), or about 0.75 mm (0.03 inches), for example.

The flange 104 may provide a degree of rigidity to the adapter 100 proximate the internal rim 106 to help prevent unintentional decoupling of the adapter 100 from a sound tube of a sound device. For example, the flange 104, located proximate the interior rim 106 may effectively increase the radial thickness of the adapter 100 proximate the interior rim 106, restricting radial expansion of the adapter 100 proximate the interior rim 106 as the adapter 100 inserted over and/or removed from a sound port of a sound device, and thus increasing the retention force retaining the adapter 100 coupled to the sound port.

Additionally as depicted in FIGS. 7A-7H, the opening 107 leads into the lumen 109 of the main portion of the body 101. The lumen 109 may be defined by the interior surface 113 and may have diameter 171. In some embodiments, the diameter 171 may be relatively constant from the opening 107 to the distal end 103. However, in other embodiments, the diameter of the lumen 109 may vary from the opening 107 to distal end 103. For example, the diameter 171 may transition from a larger diameter to a smaller diameter from the opening 107 toward the distal end 103, or the diameter 171 may transition from a smaller diameter to a larger diameter from the opening 107 toward the distal end 103.

The specific dimension chosen for the diameter 171 may be chosen to accommodate a range of sound port sizes. For instance, the diameter 171 may range anywhere between about 60% to about 125% of a chosen sound port diameter. In other instances, the diameter 171 may range anywhere between about 60% to about 110%, between about 60% to about 100%, between about 75% to about 125%, between about 75% to about 110%, or between about 75% to about 100% of a chosen sound port diameter. As one example, as mentioned above with respect to FIGS. 2A-2D, widths 32*a*-32*d* of sound ports 25*a*-25*d* may range between about 0.10 inches to about 0.30 inches, for example. Accordingly, in these examples, the diameter 171 may be chosen to be accommodate a range of sound ports having a diameter between about 2.5 mm (0.10 inches) to about 7.6 mm (0.30 inches), for example. In some instances, the diameter 171 may be anywhere between about 1.3 mm (0.05 inches) to about 9.5 mm (0.375 inches), between about 1.5 mm (0.06 inches) to about 8.4 mm (0.33 inches), or between about 2.5 mm (0.1 inches) to about 7.6 mm (0.30 inches).

Figure 7H:
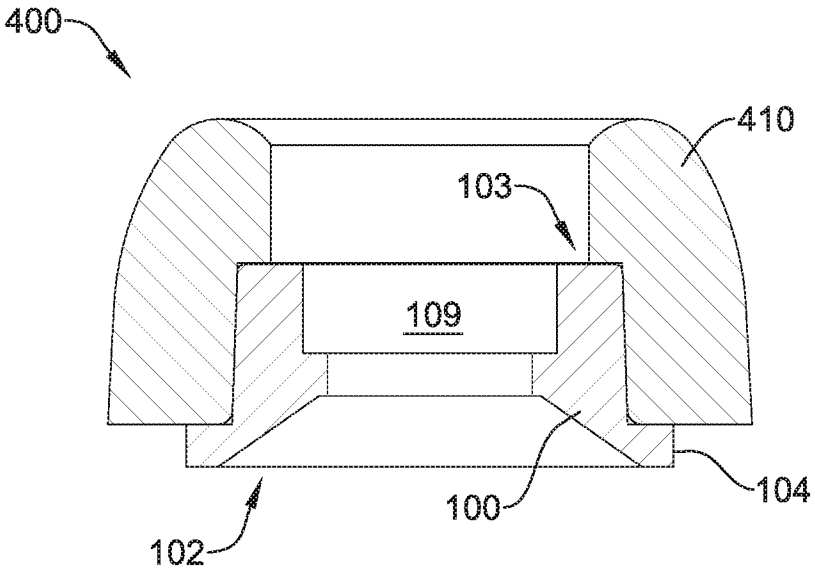
FIG. 7H is a cross-section view of the adapter of FIG. 7G including a foam ear tip.

FIG. 7H is a cross-section view of an earphone tip 400 including the adapter 100 of FIG. 7G and a cushion 410, such as a foam cushion, secured to the adapter 100. The cushion 410 may be formed of any desired resilient and/or foam material, such as a resiliently compressible polymeric foam material which may be compressed for insertion into the ear canal of a user and then undergo recovery towards its original size to closely conform to the surface of the ear canal. Some suitable foam materials include visco-elastic polyurethane foams and plasticized polyvinyl chloride foams. Other suitable polymeric foam materials are described in U.S. Pat. No. 8,327,973, which is herein incorporated by reference in its entirety. In some embodiments, the foam material may have an open cell structure, a closed cell structure, or a combination of open and closed cells, for example. The cushion 410 may have any desired shape, such as cylindrical, conical, frusta-conical, fluted, bulbous, convex, concave, or other desired shapes.

As shown in FIG. 7H, the cushion 410 may surround the body of the adapter 100 with a proximal end of the cushion 410 abutting the distal surface of the flange 104. Thus, the flange 104 may be positioned proximal of the proximal end 102 of the cushion 410. A distal portion of the cushion 410 may extend distally beyond the distal end 103 of the adapter 100.

The adapter 100 may be made from a number of different materials that impart different physical properties to the adapter 100. In some embodiments, the adapter 100 may be made from any suitable material that may provide the adapter 100 with specific properties related to hardness, tensile modulus, and static and kinetic friction. For instance, the adapter 100 may be made from a material that results in the adapter 100 having a Shore durometer hardness value of between about 40 A to about 80 A, between about 40 A to about 70 A, between about 40 A to about 65 A, or between about 45 A to about 65 A, for example.

The material that the adapter 100 is formed from may also impart the adapter 100 with specific tensile modulus values at 100% elongation. For instance, the material may give the adapter 100 a tensile modulus of 450 psi or less at 100% elongation, 350 psi or less at 100% elongation, or 250 psi or less at 100% elongation.

The kinetic coefficient of friction of the material used to form the adapter 100 may be sufficiently low to facilitate sliding the adapter 100 onto a sound port while the static coefficient of friction may be sufficiently higher to facilitate retention of the adapter 100 to the sound port. The greater the differential between the static and coefficients of friction allows the adapter 100 to slip onto the sound port easily, while resisting movement therebetween during use. Sound ports are commonly made of a acrylonitrile butadiene styrene (ABS) material, thus coefficient of friction values provided herein are those between the material of the adapter 100 and a sound port formed of acrylonitrile butadiene styrene (ABS) having a surface finish of 10 Ra.

In some embodiments, the static coefficient of friction between the material used to form the adapter 100 and the material of the sound port may be between about 0.8 to about 3.5. In other embodiments, however, the static coefficient of friction may be between about 0.8 to about 2.2, between about 0.8 to about 2.0, between about 0.8 to about 1.5, between about 0.9 to about 1.1, or between about 0.9 to about 1.0, for instance. In some embodiments, the static coefficient of friction between the material of the adapter 100 and the material of the sound port may be about 1.0, about 1.1, about 1.2, about 1.3, about 1.4, about 1.5, about 1.6, about 1.7, about 1.8, about 1.9 or about 2.0, for example.

Additionally, it may be beneficial for the kinetic coefficient of friction between the material used to form the adapter 100 and the material of the sound port to be lower than the static coefficient of friction. This may allow the adapter 100 to be more easily slid on and connected to a sound port, while better maintaining the connection once in place. In some embodiments, the kinetic coefficient of friction between the material used to form the adapter 100 and the material of sound port may be between about 0.7 to about 2.0. In other embodiments, however, the static coefficient of friction may be between about 0.7 to about 1.5, between about 0.7 to about 1.25, between about 0.75 to about 1.5, between about 0.75 to about 1.25, or between about 0.75 to about 1.0, for instance. In some embodiments, the kinetic coefficient of friction between the material of the adapter 100 and the material of the sound port may be about 0.75, about 0.85, about 1.0, about 1.25, about 1.4, or about 1.5, for example.

Some example materials that may be used to form the adapter 100 that may give the adapter 100 the described properties include various plastic materials, including thermoplastic elastomers, such as Elastocon® 8048N from TPE Technologies, Inc., TCSMEZ from Kraiburg TPE, TC6MEZ from Kraiburg TPE, OnFlex™ 60 A from PolyOne Corp., and Santoprene™ thermoplastic vulcanizate (TPV) from Exxon Mobil Corp.

| Material | Hardness (Shore A) | Tensile Modulus @ 100% elongation (psi) | Static Coefficient of Friction | Kinetic Coefficient of Friction |
|---|---|---|---|---|
| Elastocon ® 8048N | 48 | 232 | 1.03 | 0.74 |
| TC5MEZ | 50 | 310 | 1.97 | 1.43 |
| TC6MEZ | 61 | 330 | 1.88 | 1.41 |
| OnFlex ™ 60A | 60 | 319 | 1.58 | 1.27 |
| Santoprene ™ 291 | 65 | 305 | 0.98 | 0.83 |

In some instances, the material of the adapter 100 may have a Shore hardness of 60 A to 80 A, a tensile modulus at 100% elongation of 450 psi or less, or less than 450 psi, and a static coefficient of friction of 0.75 to 3.2. In some instances, the material of the adapter 100 may have a Shore hardness of 40 A to 70 A, a tensile modulus at 100% elongation of 450 psi or less, or less than 450 psi, and a static coefficient of friction of 0.75 to 3.2. In some instances, the material of the adapter 100 may have a Shore hardness of 40 A to 65 A, a tensile modulus at 100% elongation of 350 psi or less, or less than 350 psi, and a static coefficient of friction of 0.75 to 2.5. In some instances, the material of the adapter 100 may have a Shore hardness of 45 A to 65 A, a tensile modulus at 100% elongation of 325 psi or less, or less than 325 psi, and a static coefficient of friction of 0.75 to 2.0. In some instances, the material of the adapter 100 may have a Shore hardness of 45 A to 65 A, a tensile modulus at 100% elongation of 250 psi or less, or less than 250 psi, and a static coefficient of friction of 0.75 to 1.8. In some instances, the material of the adapter 100 may have a Shore hardness of 45 A to 50 A, a tensile modulus at 100% elongation of 300 psi or less, or less than 300 psi, and a static coefficient of friction of 0.9 to 1.1. In some instances, the material of the adapter 100 may have a Shore hardness of 60 A to 65 A, a tensile modulus at 100% elongation of 325 psi or less, or less than 325 psi, and a static coefficient of friction of 1.5 to 1.7. In some instances, the material of the adapter 100 may have a Shore hardness of 60 A to 65 A, a tensile modulus at 100% elongation of 310 psi or less, or less than 310 psi, and a static coefficient of friction of 0.9 to 1.0.

Figure 8:
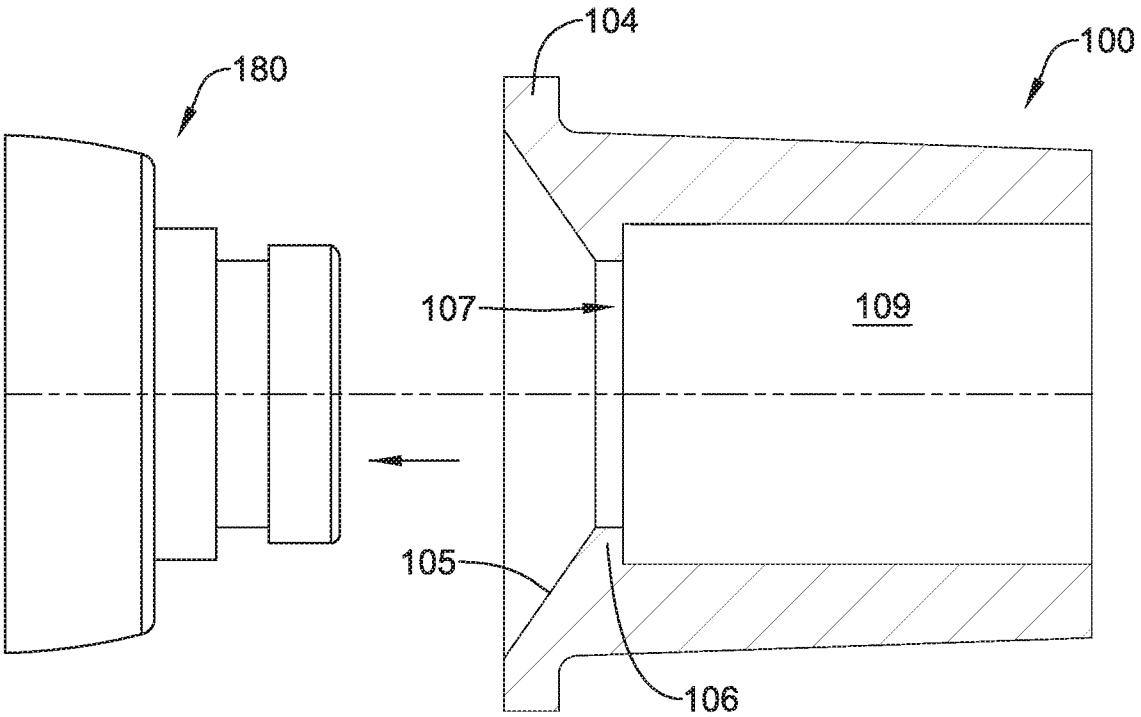
FIG. 8 is a plan view of an exemplary sound port and cross-sectional view of an adapter of the present disclosure illustrating alignment of the adapter with the sound port.

As shown in FIG. 8, a sound port may 180 be inserted through the proximal end 102 of the adapter 100 with the central longitudinal axis of the adapter 100 coaxially aligned with the central longitudinal axis of the sound port 180 of the sound device. During this connection process, the sound port 180 may initially contact the conical or funnel-shaped lead-in face 105, prior to being advanced distally through the opening 107 and past the internal rim or retention member or members 106, as the adapter 100 is being connected to the sound port 180. The major diameter of the lead-in face 105 (i.e., the diameter proximate the proximal end 102) may be greater than or equal to the diameter of the largest sound port the adapter 100 is configured to be connected to. Furthermore, the minor diameter of the lead-in face 105 (i.e., the diameter proximate the interior rim 106), may be less than the diameter of the largest sound port the adapter 100 is configured to be connected to, yet the diameter 171 of the lumen 109 may be greater than the diameter of the smallest sound port the adapter 100 is configured to be connected to.

In some embodiments, it may be beneficial for the lead-in face 105 to have differing properties, particularly in relation to static and kinetic coefficients of friction, than other portions of the adapter 100. Accordingly, the force required during the connection process to connect the adapter 100 to the sound port 180 may be reduced if the lead-in face 105 has relatively lower static and kinetic coefficients of friction. In some of these embodiments where the lead-in face 105 has relatively lower static and/or kinetic coefficients than other portions of the adapter 100, the lead-in face 105 may be made from a different material than other portions of the adapter 100 and/or the remainder of the adapter 100. In other embodiments, the lead-in face 105 may be formed from the same material as the rest of the adapter 100, but may be coated with a different material that has relatively lower static and/or kinetic coefficients of friction, such as a slip coating. Some suitable coating materials for coating the lead-in face 105 include a polytetrafluoroethylene (PTFE) or silicone powder or spray. In still other embodiments, the lead-in face 105 may be patterned with a micro-texture that gives the lead-in face 105 relatively lower static and/or kinetic coefficients of friction. For example, the surface of the lead-in face 105 (attributed to a different material, coating layer, surface treatment or modification, etc.) may have a static coefficient of friction of 2.0 or less and a kinetic coefficient of friction of 1.5 or less, a static coefficient of friction of 1.75 or less and a kinetic coefficient of friction of 1.25 or less, a static coefficient of friction of 1.25 or less and a kinetic coefficient of friction of 1.0 or less, or a static coefficient of friction of 1.0 or less and a kinetic coefficient of friction of 0.85 or less, in some instances.

Figure 9B:
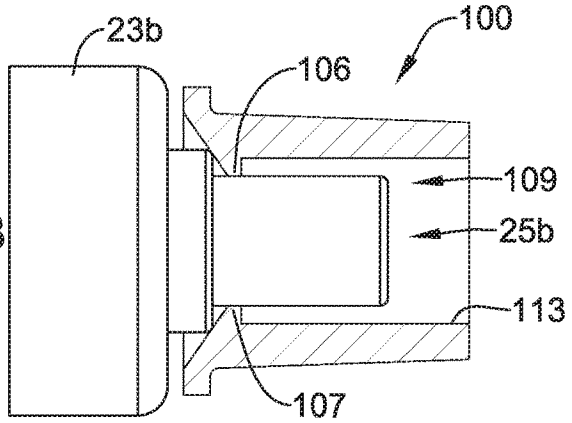
FIGS. 9A-9D are plan views of the exemplary sound ports of FIGS. 2A-2D with an exemplary adapter coupled thereto.
Figure 9D:
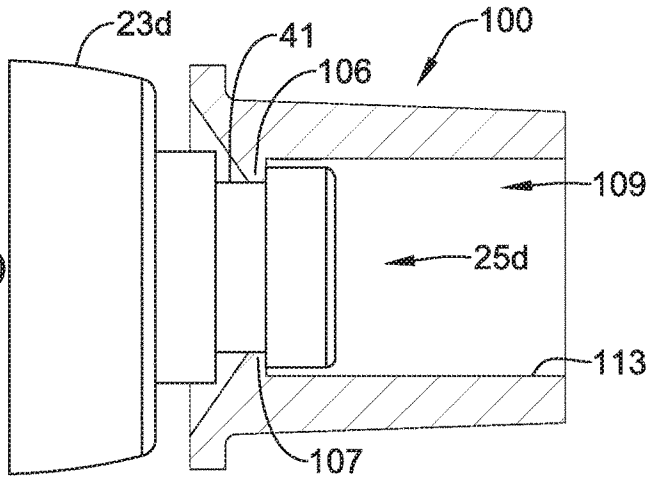
Figure 9A:
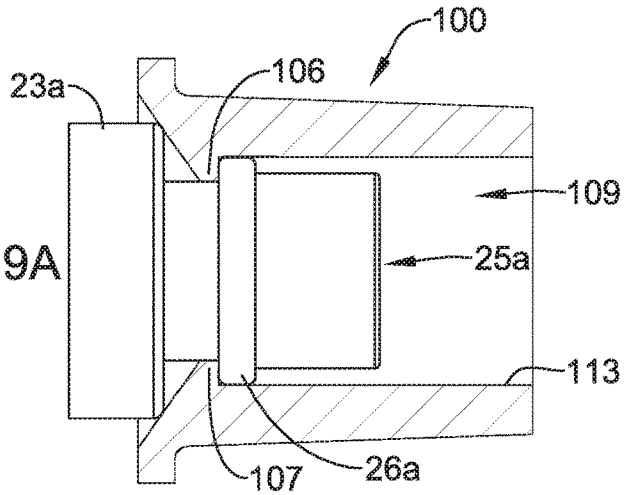

FIGS. 9A-9D are plan views of the exemplary sound ports of FIGS. 2A-2D, respectively, with an exemplary adapter or core 100, shown in cross-section, coupled thereto. As shown in FIG. 9A, the adapter 100 may be coupled to the sound port 25*a*, with the sound port 25*a* extending through the opening 107 such that the interior rim 106 engages the barb 26*a* and provides an interference fit therewith. Thus, the opening 107 may have a diameter less than the diameter of the barb 26*a*. In instances in which the diameter of the sound port 25*a* is greater than the diameter of the lumen 109 of the body of the adapter 100, the exterior surface of the sound port 25*a* may additionally engage the interior surface 113 of the main body of the adapter 100 distal of the interior rim 106.

As shown in FIG. 9B, the adapter 100 may be coupled to the sound port 25*a*, with the sound port 25*a* extending through the opening 107 with the interior rim 106 engaging the sound port 25*b*. The opening 107 may have a diameter less than the diameter of the sound port 25*b* to provide an interference or frictional fit therewith to retain the adapter 100 on the sound port 25*b*. In instances in which the diameter of the sound port 25*b* is greater than the diameter of the lumen 109 of the body of the adapter 100, the exterior surface of the sound port 25*b* may additionally engage the interior surface 113 of the main body of the adapter 100 distal of the interior rim 106.

Figure 9C:
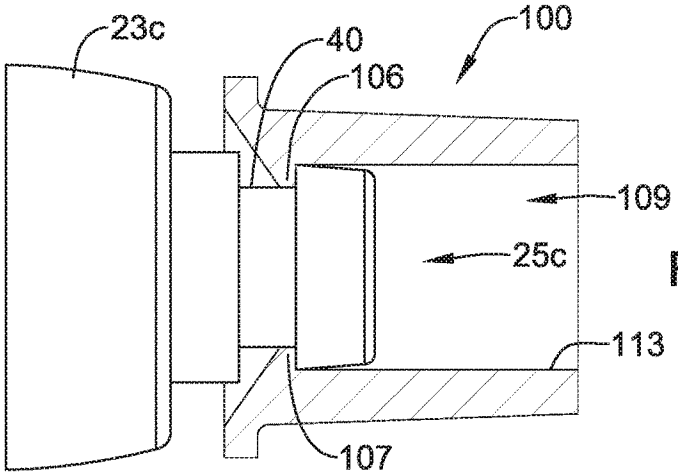

As shown in FIG. 9C, the adapter 100 may be coupled to the sound port 25*c*, with the tapered cone portion of the sound port 25*c* extending through the opening 107 such that the interior rim 106 extends into the recess 40. Thus, the opening 107 may have a diameter less than the diameter of the tapered cone portion of the sound port 25*c*, while the diameter of the opening 107 may be less than or greater than the diameter of the recess 40 to provide an interference fit between the shoulder of the interior rim 106 and the edge of the recess 40 to retain the adapter 100 on the sound port 25*c*. In instances in which the diameter 107 is less than the diameter of the recess 40, the interior rim 106 may engage the base of the recess 40. In instances in which the diameter of the tapered cone portion of the sound port 25*c* is greater than the diameter of the lumen 109 of the body of the adapter 100, the exterior surface of the tapered cone portion of the sound port 25*c* may additionally engage the interior surface 113 of the main body of the adapter 100 distal of the interior rim 106.

As shown in FIG. 9D, the adapter 100 may be coupled to the sound port 25*d*, with the cylindrical end portion of the sound port 25*d* extending through the opening 107 such that the interior rim 106 extends into the recess 41. Thus, the opening 107 may have a diameter less than the diameter of the cylindrical end portion of the sound port 25*d*, while the diameter of the opening 107 may be less than or greater than the diameter of the recess 41 to provide an interference fit between the shoulder of the interior rim 106 and the edge of the recess 41 to retain the adapter 100 on the sound port 25*d*. In instances in which the diameter of the cylindrical portion of the sound port 25*d* is greater than the diameter of the lumen 109 of the body of the adapter 100, the exterior surface of the cylindrical portion of the sound port 25*d* may additionally engage the interior surface 113 of the main body of the adapter 100 distal of the interior rim 106.

Figure 10A:
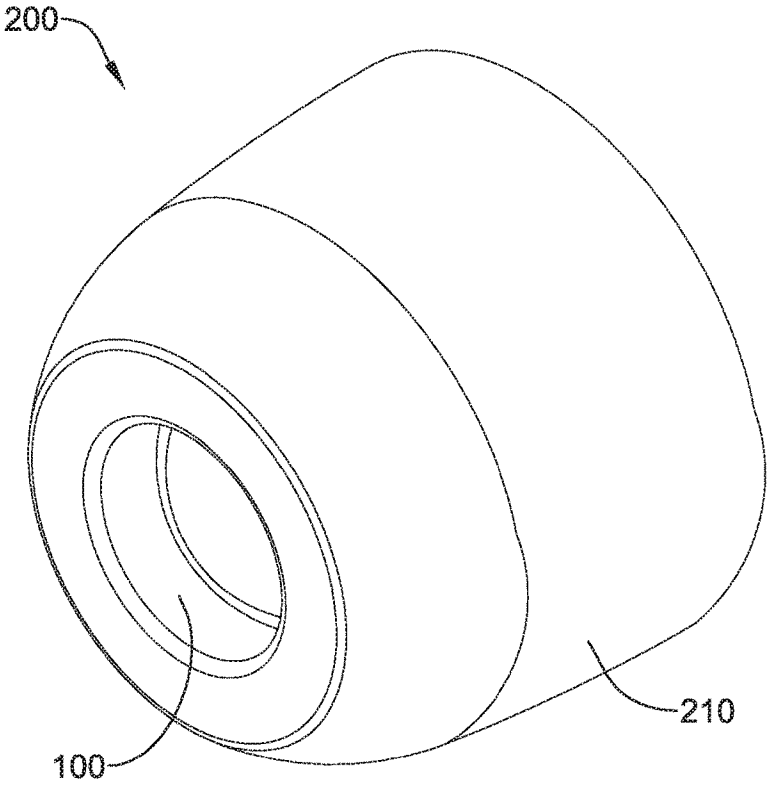
FIGS. 10A and 10B are different perspective views of an exemplary earphone tip incorporating an adapter of the present disclosure.
Figure 10B:
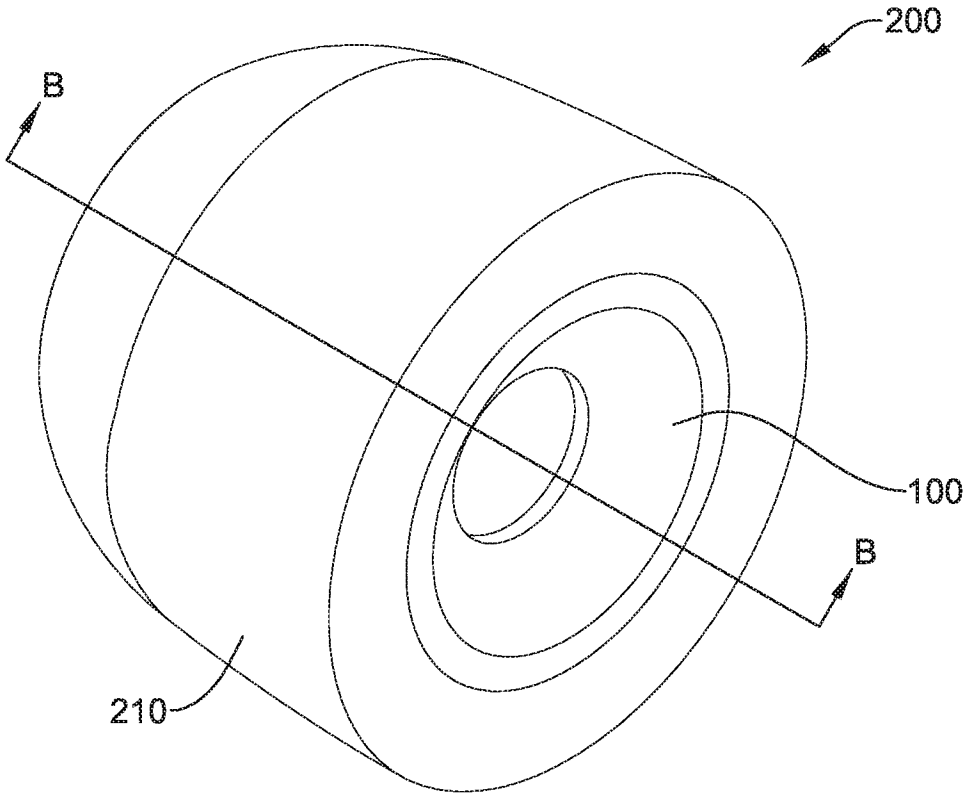

FIGS. 10A and 10B are perspective views of an earphone tip 200 including the adapter 100 and a cushion 210, such as a foam cushion, secured to the adapter 100. The cushion 210 may be formed of any desired resilient and/or foam material, such as a resiliently compressible polymeric foam material which may be compressed for insertion into the ear canal of a user and then undergo recovery towards its original size to closely conform to the surface of the ear canal. Some suitable foam materials include visco-elastic polyurethane foams and plasticized polyvinyl chloride foams. Other suitable polymeric foam materials are described in U.S. Pat. No. 8,327,973, which is herein incorporated by reference in its entirety. In some embodiments, the foam material may have an open cell structure, a closed cell structure, or a combination of open and closed cells, for example. The cushion 210 may have any desired shape, such as cylindrical, conical, frusta-conical, fluted, bulbous, convex, concave, or other desired shapes.

Figure 11:
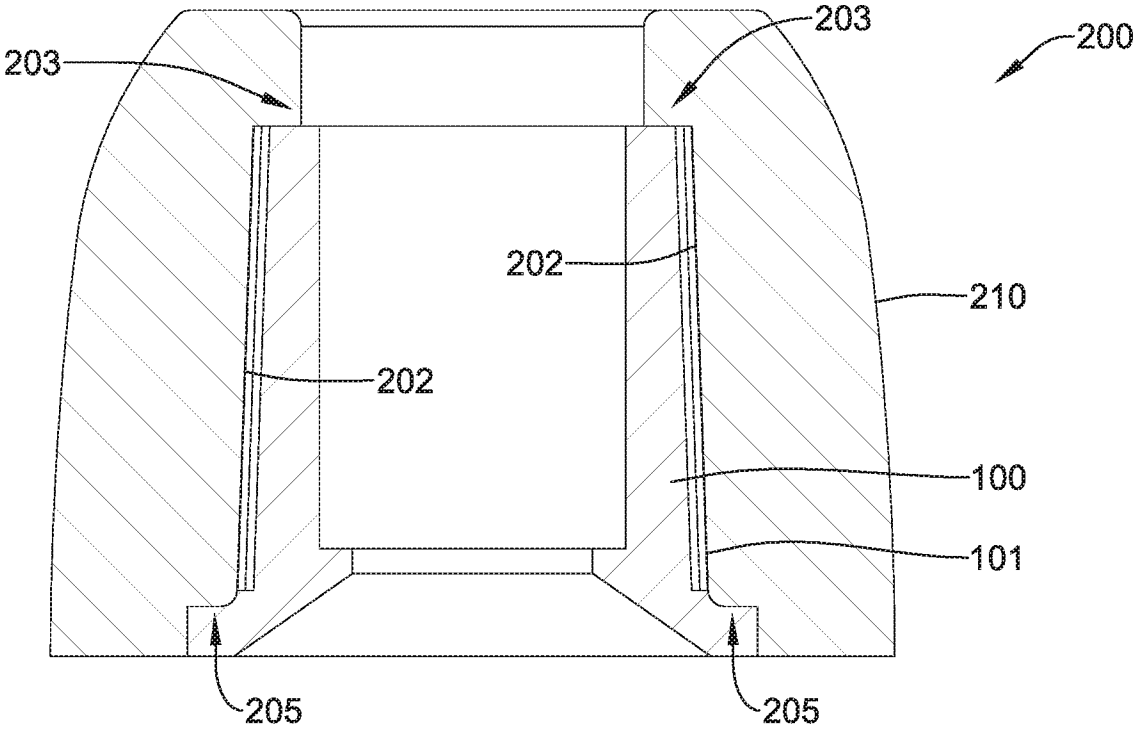
FIG. 11 is a cross-section view of the earphone tip of FIG. 10B as viewed along line B-B of FIG. 10B.

FIG. 11 depicts a cross-sectional view of the earphone tip 200 as viewed along line B-B of FIG. 10B. As can be seen in FIG. 11, the cushion 210 may circumferentially surround the adapter 100, with an interior surface of the cushion 210 secured (e.g., adhesively bonded or overmolded) to the peripheral/circumferential surface of the body 101 of the adapter 100. The internal surface 202 of the cushion 210 may conform to the contour of the adapter 100, and thus may, in some instances, include extensions 203 and/or cavities 205 that conform to the adapter 100. In some instances, the cushion 210 may extend distal of the distal end of the adapter 100 to provide a soft, compliant tip for insertion into the ear canal of a user.

Figure 12:
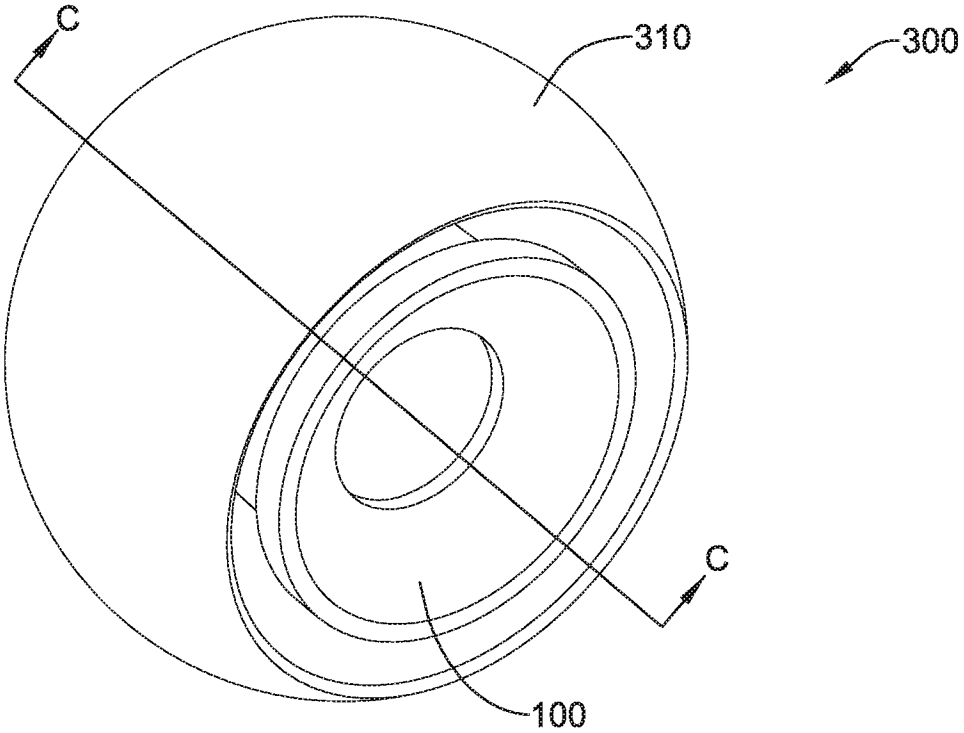
FIG. 12 is a perspective view of another exemplary earphone tip incorporating an adapter of the present disclosure.
Figure 13:
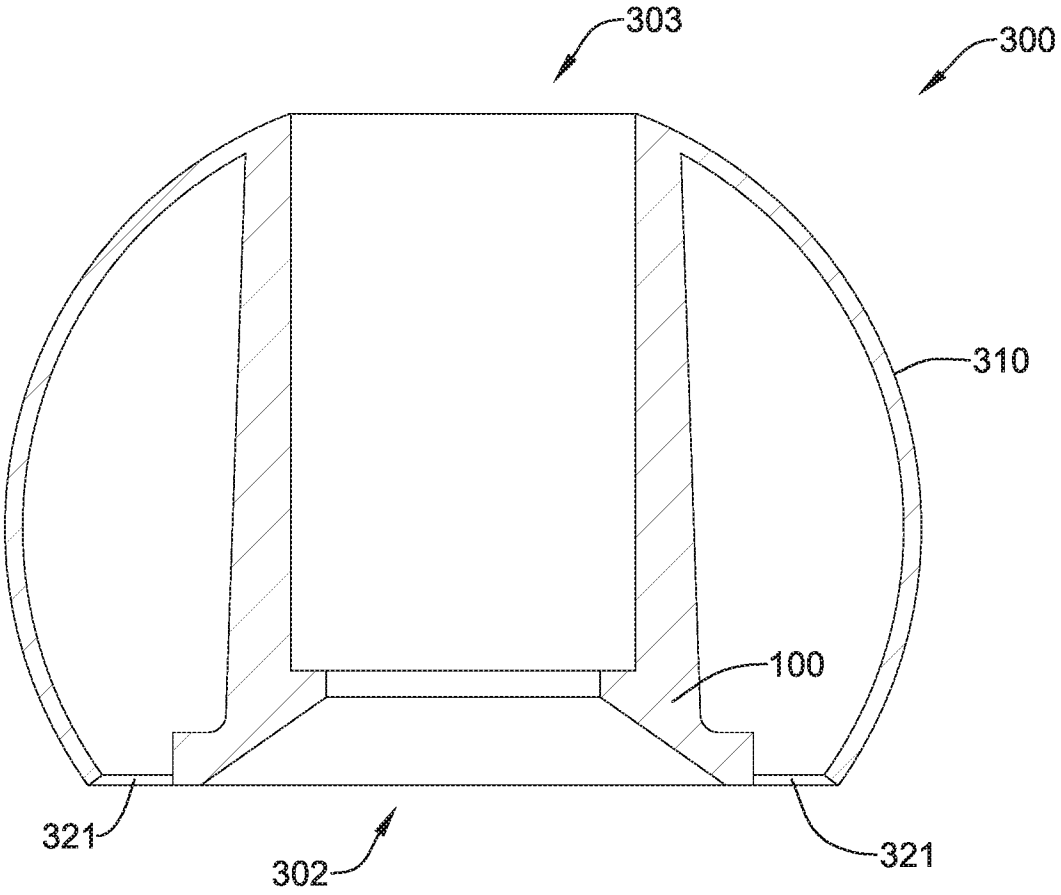
FIG. 13 is a cross-section view of the exemplary earphone tip of FIG. 12 as viewed along line C-C of FIG. 12.

FIGS. 12 and 13, illustrate another embodiment of an earphone tip 300, incorporating the adapter 100, formed as a monolithic structure with the cushion 310. FIG. 12 shows a perspective view of the earphone tip 300, while FIG. 13 depicts a cross-section of the earphone tip 300 as viewed along line C-C in FIG. 12.

Generally, the adapter 100 may be similar in structure and properties to that described above, with the inclusion of the cushion 310 circumferentially surrounding the adapter 100. The material of the earphone tip 300, and thus the cushion 310, may be any desired soft, pliable polymeric material, such as a silicone material, including silicone based materials, which may be inserted into the ear canal of a user and closely conform to the surface of the ear canal. As can be seen best in FIG. 13, the cushion 310 may be secured to and extend from the adapter 100 at the distal end of the adapter 100 proximate the distal end 303 of the earphone tip 300, and may generally curve outward and proximally therefrom, toward the proximal end of the adapter 100 and the proximal end 302 of the earphone tip 300. In some embodiments, the bottom edge 321 (e.g., circumferential edge) of the cushion 310 may terminate in line with the proximal end of the adapter 100. However, in other embodiments, the bottom edge 321 may terminate proximal of or distal of the proximal end of the adapter 100.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed:

1. An earphone tip configured to be detachably coupled to a sound tube of an earbud-type sound device or other sound device, regardless of sound tube diameter and external surface features, the earphone tip comprising:

an adapter body including a proximal portion and a distal portion having an internal surface defining a lumen extending therethrough from a proximal end to a distal end along a central longitudinal axis;

a lead-in face in the proximal portion of the lumen defined by a distally extending reduction in lumen diameter that aids insertion of the sound tube into the lumen, the reduction in lumen diameter being from a larger diameter of about 4.3 mm to about 8.4 mm at the proximal end of the adapter body to a smaller diameter of about 2.0 mm to about 4.1 mm over an axial length of the lumen of about 0.5 mm to about 1.8 mm; and one or more retention members in the distal portion of the lumen, the one or more retention members extending radially inward within the lumen, wherein the distal portion of the lumen has a diameter of about 3.0 mm to about 5.1 mm and the one or more retention members extend inward a distance of about 0.127 mm to about 1.5 mm, the one or more retention members located within a range of about 0.8 mm to about 1.8 mm from the proximal end of the lumen.

2. The earphone tip of claim 1, further comprising a radially outwardly extending flange disposed at the proximal end of the adapter body.

3. The earphone tip of claim 2, wherein the adapter body comprises a longitudinally extending groove in an outer surface of the adapter body from the flange to the distal end of the adapter body.

4. The earphone tip of claim 1, wherein the face slopes at an angle between 30 degrees and 60 degrees with respect to the central longitudinal axis.

5. The earphone tip of claim 1, wherein the face has a lower static coefficient of friction than the internal surface of the adapter body.

6. The earphone tip of claim 1, wherein the face comprises a material having a lower static coefficient of friction than the static coefficient of friction of the material of the internal surface of the adapter body.

7. The earphone tip of claim 1, wherein the face is coated with a material having a lower static coefficient of friction than the static coefficient of friction of the material of the internal surface of the adapter body.

8. The earphone tip of claim 1, wherein the one or more retention members are located a distance from the proximal end that is less than forty percent of a distance between the proximal end and the distal end of the adapter body.

9. The earphone tip of claim 1, wherein the one or more retention members project from the internal surface at an angle between 30 degrees and 150 degrees.

10. The earphone tip of claim 1, wherein the adapter body comprises a material having a Shore hardness value between 40 A and 80 A.

11. The earphone tip of claim 1, wherein the adapter body is formed of a material having a Shore hardness of 40 A to 65 A, a tensile modulus at 100% elongation of 350 psi or less, or less than 350 psi, and a static coefficient of friction of 0.75 to 2.5.

12. The earphone tip of claim 1, further comprising a cushion circumferentially surrounding the adapter body and configured to frictionally engage an ear canal of a user.

13. The earphone tip of claim 12, wherein the cushion is formed as a monolithic structure with the adapter body.

14. The earphone tip of claim 13, wherein the cushion and the adapter body are made of a silicone material.

15. The earphone tip of claim 12, wherein the cushion is formed of a polymeric foam material.

16. The earphone tip of claim 1, wherein an inner diameter defined by the one or more retention members is less than the diameter of the lumen at the distal end.

17. An earphone tip configured to be detachably coupled to a sound port of an earbud-type sound device or other sound device, regardless of sound port design, the earphone tip comprising:

an adapter body extending from a proximal end to a distal end, wherein an internal surface of the adapter body defines a lumen extending through the adapter body along a central longitudinal axis, wherein the adapter body includes a flange at the proximal end of the adapter body extending radially outward from an exterior surface of the adapter body, and wherein the exterior surface of the adapter body extends a first distance radially from the central longitudinal axis adjacent the flange and the exterior surface of the adapter body extends a second distance radially from the central longitudinal axis at the distal end, the first distance being greater than the second distance, the lumen further defining an axially extending proximal portion and a distal portion;

a lead-in face in the proximal portion of the lumen defined by a distally extending reduction in lumen diameter that aids insertion of the sound tube into the lumen, the reduction in lumen diameter being from a larger diameter of about 4.0 mm to about 8.4 mm at the proximal end of the adapter body to a smaller diameter of about 2.0 mm to about 4.1 mm over an axial length of the lumen of about 0.5 mm to about 1.8 mm; and one or more retention members in the distal portion of the lumen, the one or more retention members extending radially inward within the lumen, wherein the distal portion of the lumen has a diameter of about 3.0 mm to about 5.1 mm and the one or more retention members extend inward a distance of about 0.127 mm to about 1.5 mm, the one or more retention members located within a range of about 0.8 mm to about 1.8 mm from the proximal end of the lumen.

18. The earphone tip of claim 17, wherein the inwardly extending face has a lower static coefficient of friction than the internal surface of the adapter body.

19. The earphone tip of claim 17, wherein the inwardly extending face slants away from the proximal end of the adapter body at an angle of between 30 degrees and 60 degrees.

20. The earphone tip of claim 17, wherein the adapter body comprises a plastic material.

21. The earphone tip of claim 20, wherein the plastic material has a Shore hardness of 40 A to 65 A, a tensile modulus at 100% elongation of 350 psi or less, and a static coefficient of friction of 0.75 to 2.5.

22. The earphone tip of claim 17, wherein the inwardly extending face extends toward the distal end of the adapter body to a point a distance away from the proximal end that is between 10% and 40% of a distance between the proximal end of the adapter body and the distal end of the adapter body.

23. The earphone tip of claim 17, wherein the adapter body has a longitudinally extending groove formed in the exterior surface of the adapter body from the flange to the distal end of the adapter body.

24. An earphone tip detachably coupleable to an earbud-type sound device or other sound device, the earphone tip comprising:

an adapter body including a lumen extending from a proximal end to a distal end along a central longitudinal axis;

wherein the adapter body includes a radially outwardly extending flange at the proximal end and a longitudinally extending groove formed in an exterior surface of the adapter body from the flange to the distal end; and a cushion attached to the adapter body, the cushion configured to frictionally engage an ear canal of a user, wherein the adapter body is configured to connect securely to any one of a plurality of different sound port configurations of an earbud-type sound device or other sound device.

25. The system of claim 24, wherein the adapter body further comprises an internal surface defining the lumen and an internal rim extending inwardly from the internal surface of the adapter body.

26. The system of claim 24, wherein the adapter body is formed of a material having a Shore hardness of 40 A to 65 A, a tensile modulus at 100% elongation of 350 psi or less, or less than 350 psi, and a static coefficient of friction of 0.75 to 2.5.

* * * * *